US012145709B2

(12) United States Patent
Gibson et al.

(10) Patent No.: US 12,145,709 B2
(45) Date of Patent: Nov. 19, 2024

(54) MOTOR MOUNT FOR NON-POWERED SMALL VESSEL

(71) Applicants: Nicholas Fenley Gibson, Lexington, KY (US); Shaun Conley Green, Richmond, KY (US)

(72) Inventors: Nicholas Fenley Gibson, Lexington, KY (US); Shaun Conley Green, Richmond, KY (US)

( * ) Notice: Subject to any disclaimer, the term of this patent is extended or adjusted under 35 U.S.C. 154(b) by 454 days.

(21) Appl. No.: 17/720,672

(22) Filed: Apr. 14, 2022

(65) Prior Publication Data

US 2022/0332402 A1 Oct. 20, 2022

Related U.S. Application Data

(60) Provisional application No. 63/174,625, filed on Apr. 14, 2021.

(51) Int. Cl.

| | |
|---|---|
| ***B63H 21/30*** | (2006.01) |
| ***B63B 34/10*** | (2020.01) |
| ***B63B 34/20*** | (2020.01) |
| ***B63B 34/26*** | (2020.01) |
| ***B63H 20/00*** | (2006.01) |
| ***B63H 20/02*** | (2006.01) |
| ***B63H 20/06*** | (2006.01) |
| ***B63H 20/08*** | (2006.01) |
| ***B63H 21/17*** | (2006.01) |

(Continued)

(52) U.S. Cl.

CPC ..... *B63H 21/30* (2013.01); *B63B 34/10* (2020.02); *B63B 34/20* (2020.02); *B63B 34/26* (2020.02); *B63H 20/007* (2013.01); *B63H 20/02* (2013.01); *B63H 20/06* (2013.01); *B63H 20/08* (2013.01); *B63H 21/17* (2013.01); *B63H 21/213* (2013.01); *B63H 25/42* (2013.01); *B63H 2020/003* (2013.01); *B63H 2021/216* (2013.01)

(58) Field of Classification Search

CPC ..... B63B 34/10; B63B 34/20; B63B 34/26; B63H 20/007; B63H 20/02; B63H 20/06; B63H 20/08; B63H 20/10; B63H 20/12; B63H 21/17; B63H 21/213; B63H 2021/216; B63H 21/30; B63H 25/42

See application file for complete search history.

(56) References Cited

U.S. PATENT DOCUMENTS

| | | | | |
|---|---|---|---|---|
| 3,245,640 A * | 4/1966 | Ibbs | B63H 20/007 248/642 |
| 5,389,017 A * | 2/1995 | Huzjak | B63H 20/10 248/641 |
| D524,716 S * | 7/2006 | Hill | D8/354 |

(Continued)

*Primary Examiner* — Ajay Vasudeva
(74) *Attorney, Agent, or Firm* — Michael Coblenz

(57) ABSTRACT

A device for mounting one or more electric motors to a kayak or a small non-powered vessel, whereby a rotatable assembly is mounted on the gunnel of the vessel on either the port or starboard side, or both. The rotatable assembly includes an axle and an adjustable arm rotatably mounted thereon, with a motor on the end of the adjustable arm The rotatable assembly may be manipulated to move the motor(s) into or out of the water and lock in either position. The adjustable arm allows the motor to be adjusted in the pitch, yaw, and roll orientations. The motor(s) are powered by a battery and controlled by a hand-held unit that allows the motors to be independently operated.

17 Claims, 9 Drawing Sheets

(51) Int. Cl.
*B63H 21/21* (2006.01)
*B63H 25/42* (2006.01)

(56) References Cited

U.S. PATENT DOCUMENTS

| | | | | |
|---|---|---|---|---|
| 7,887,381 | B2 | 2/2011 | Brass et al. | |
| 8,516,973 | B1 | 8/2013 | Hamilton | |
| 9,290,251 | B1 | 3/2016 | Schmidtke | |
| 10,053,200 | B1 | 8/2018 | Koetsier et al. | |
| 11,247,764 | B2 * | 2/2022 | Lammers-Meis | B63H 25/02 |
| 11,858,599 | B2 * | 1/2024 | Becker | B63B 34/10 |
| 2010/0136857 | A1 * | 6/2010 | Goudsmit | H02K 7/1823 440/6 |
| 2014/0364020 | A1 | 12/2014 | Stone et al. | |
| 2016/0229510 | A1 | 8/2016 | Aguirre | |

* cited by examiner

MOTOR MOUNT FOR NON-POWERED SMALL VESSEL

This application claims priority to U.S. provisional application Ser. No. 63/174,625 filed on Apr. 14, 2021, and fully incorporated herein by reference.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

The invention relates to a mounting system to add a motor or pair of motors to a non-powered kayak or other small non-powered water vessel.

The general purpose of this invention is to provide a means of equipping a conventional kayak, canoe, or other small water going vessel with electric propulsion, where the vessel was not otherwise equipped from the original manufacturer, and regardless of the form factor or features of that vessel, and in a manner whereby the vessel may be expeditiously returned to its original intended function at will, without the use of tools or special equipment.

Description of Related Art

The users of kayaks and other small boats or water vessels occasionally engage in activities that require both the use of the hands to engage in the activity and propulsion to move the vessel. The most common is fishing, but there are a number of other activities where it is unwieldly to engage in the activity and row or propel the vessel. It is not uncommon, therefore, to temporarily attach a small motor to the vessel. The most common and well known is a small, well known, trolling motor.

One of the ways the invention outlined here differs from currently available retrofittable mounting systems for kayaks is that it foregoes the dependency of traditional trolling motors in favor of a more streamlined and compact means of propulsion. The mounting system described herein is specifically adapted to accept small, efficient, ROV (remotely operated vehicle) style shrouded thrusters at the end of an already compact frame assembly. ROVs are well known in the art. Other mounting systems use conventional trolling motors with a long support shaft and encased motor controls high above the water, with a tiller handle, mounted to a permanently fixed member attached to the vessel. This makes for a disproportionately large form factor compared to most canoes and kayaks, reducing their versatility for both highway transportation, portaging, and use in tight/low head clearance areas. Even when retracted from the water, traditional trolling motor sizes do not permit the same clearance conditions as the smaller, thruster style ROV motor. An added benefit of the ROV type thruster motor is that, due its smaller size and prop shrouding, it is capable of operating at a shallower depth than the open prop style trolling motor, which must be placed further into the water to reduce surface cavitation, resulting in reduced capability for shallow water applications.

In addition to streamlining the drive motors as well as the mounting assembly/form factor for uses more in line with small vessels, the invention solves problems associated with single motor propulsion. In the case of transom mounted propulsion systems, only transom-equipped kayaks are viable candidates for adding propulsion. The transom is the typically and primarily vertical and flat stern section of a vessel. Transom equipped vessels are typically several times more expensive than beginner or intermediate style boats, are much less common, and geared for specific uses such as fishing; only a small percentage of kayaks are so equipped from the manufacturer. Secondly, the mounting systems used on non-transom equipped kayaks are typically side-mounted devices intended for use exclusively with a single prop trolling motor. These side mounting systems feature unreliable, single line-of-action propulsive force, which does not evenly distribute the motor thrust into the hull, resulting in both instability of the boat, as well as high stress concentrations along the line of action of mounting, compromising the boat hull attachment anchors and even the hull itself. A system utilizing a dual trolling motor configuration incurs the added expense, weight, and cost of two separate trolling motors, not to mention a lack of an integrated control system designed to synchronize the motor inputs. The speed and direction of a two-motor system utilizing retro-fitted trolling motors would feature independently controlled inputs from each tiller/throttle handle, which can lead to conflicting inputs of steering and throttle position, increasing the likelihood of tip over and instability, depending on the operator, not to mention requiring constant two-handed operation. Finally, trolling motors are almost exclusively sized for much larger craft, such as a metal john boats or larger vessels. The oversized nature of available motors vs. conventional single man kayaks further enhances the issues of instability, as kayak hulls are not designed for the forces such motors are designed to exert.

Finally, the invention described herein utilizes single-handed, set-position throttle operation, or alternatively, a hands-free foot control of all fore/aft and rotational motion, eliminating the need for constant minding of the throttle and directional input, so the operator is free to attend other tasks inside the vessel, such as casting/reeling while fishing. In typical, single motor kayak motor mounting system, the motor must be rotated in the horizontal plane in order that the vessel change direction. The need to rotate the motor in the horizontal plane requires a handle or tiller mechanism often placed inconveniently behind the rider of a typical kayak. By placing a fixed motor on either side of the vessel, the invention here eliminates the need for horizontal rotation of the motor, as the motor thrust is adjusted to achieve rotation. Furthermore, the thrust controls for each motor are remotely located from the motor mounting assemblies, placing the controls conveniently in front of the operator for single point access motor thrust control.

SUMMARY OF THE INVENTION

The invention consists of two longitudinally mounted axles removably mounted on either side of the vessel, and with an adjustable motor mount having a small motor disposed at the end of the adjustable motor mount. The motor mounts can be rotated on the axles to move the motors into or out of the water. The adjustable motor mount can be lengthened or shortened to allows the motor to be position deeper in the water relative to the vessel, and is adjustable to allow the pitch and yaw of the motor to be adjusted. It is within the conception of the invention to use one or two motors, and hence one or two motor mounts and attachable axles. The invention also includes an onboard battery to power the motors as well as electronic controllers to allow the user to fully control the motors.

A complete execution of the device is described not only a means of mounting electric motors onto a vessel, but also to provide method of distributing electric power and controlling the speed of the motors to command full manipulation of the vessel. This deems it essential that, in every case of implementation, the device includes several major components intended to remedy all issues of portability and practical operation that plague various other commercially available methods of fixing drive motors onto a kayak or other small vessel. The dual motor assemblies shown in the embodiment herein details the full function and operating conditions along with each major component's role in the overall function of the device.

In the preferred embodiment, the device will be powered by two motors total, one on each side, with a standard dual throttle hand control. The various motors will be similar in design, and of the brushless DC type, albeit in various states of tune and output levels, according to the customer's desire and budget. For the purpose of this disclosure, one motor and mounting mechanisms is shown for simplicity. This motor is of a similar style, type, and size to all motor options commonly available, though it is within the conception of the invention to use DC motors of various types and sizes; the assembly was designed from the outset to absorb a myriad of motor architectures. In addition, shown in this embodiment as the power source will be the conventional and cost-effective deep cycle AGM lead acid battery, utilized for both it's low cost and ample range, though it is important to note the system is designed to function per the intent from any deep cycle AGM or LiPo battery between voltages of 6 and 22V. Beyond the bounds given above regarding operating voltages, all other discussion concerning battery size, capacity, and type will be left out of the discussion.

The most significant differentiator across potential embodiments of the device is quantity of motors used in the application. More specifically, the dual motor embodiment differs most from other applications such as the stripped down, low cost, single motor configuration. This single motor example is mentioned for the user who wants a motor assisted vessel, mounted in the same manner as that shown throughout in the dual-motor configuration, only mounted on a single side. The resulting one-sided application of thrust to the vessel compromises steering and top speed capability. Notably, this option is anticipated to be more popular in a paddle board application, as it's reduced overall power is likely not as much of a compromise as would be the case with heavier kayaks, canoes, or row boats. In the single motor embodiment, the operator only has forward/reverse capability, and no torque-vector steering capability. In this embodiment, the operator uses a single throttle motor control and is dependent on manual paddle manipulation for steering maneuvers. It is important to point out here that the style and architecture of the single mount option differs only from the dual motor embodiment in quantity of assemblies. Single motor optioned devices will be delivered from the same components as the dual motor setup, only with approximately half of the parts of the dual motor, with the exception of the waterproof throttle housing. In the case of the single motor setup, the customer will select their preference of a right or left-handed motor mount assembly, yielding roughly half the cost of the dual motor setup.

Aside from the motor quantity, the second most considerable deviation from the embodiment standardized within the diagrams of this document lies in the type of operator controls applied to the device. Notable here is the fact that, regardless of whether the setup consists of a single motor or plurality of motors, the same resulting function may be given to the operator via hand operated throttle, or a hands-free, foot operated embodiment. In both the case of hand and foot-controlled devices, the principle of a detachable mounting scheme for easy removal and installation remains universal.

The invention consists of a device for mounting an electric motor onto a kayak, canoe, rowboat, or other small waterborne craft, otherwise not equipped from the manufacturer, comprising: an axle, fixed at each end, is attached to the vessel approximately along the port and/or starboard side gunnel, where the axle is used to constrain a rotatable arm such that the rotational axis of that arm exists primarily longitudinally relative to the vessel, and where the arm features a means of attaching an electric motor approximately at its end, with the arm being allowed rotational freedom such that the motor may be manipulated into a fixed position either above or below the waterline relative to the vessel. The device can be implemented in a tandem configuration on both the port and starboard side of the vessel, where thrust from the resultant plurality of motors, each driving from opposite sides of the centerline of the vessel, may be manipulated to provide complete rotational control of the vessel. In the preferred embodiment, the device for mounting an electric motor to a small non-powered vessel having a hull with a port side with a port side gunnel and a starboard side with a starboard side gunnel, comprises, a pair of mounting holes drilled into one of said gunnels of the vessel; a pair of adjustable clamps having well-nuts, wherein said well-nuts are removably inserted and secured into said mounting holes; an axle having a distal and a proximal end secured in said adjustable clamps; a rotatable weldment rotatably attached to said axle, said weldment having a weldment attachment plate; an L-shaped mounting arm having a horizontal plate and a vertical plate, wherein said horizontal plate is rotatably attached to said attachment plate; an adjustable lower member attached to said vertical plate; a motor rotatably attached to said adjustable lower member, wherein said motor has a direction of thrust; wherein said weldment can be rotated about said axle to position said motor into or out of the water; wherein further said vessel has a center point of mass, and a longitudinal axis running longitudinally from a bow of the vessel to a stern of the vessel through said center point of mass, wherein the vessel may roll about said longitudinal axis; a vertical axis running vertically through said center point of mass, wherein the vessel may yaw about the vertical axis and the bow of the vessel may move left or right; a lateral axis running laterally from the port side of the vessel to the starboard side of the vessel through the center point of mass, wherein the vessel may pitch about the lateral axis and the bow of the vessel may move up or down; wherein said axle is mounted parallel to said longitudinal axis of said vessel; wherein said rotational attachment between the weldment attachment plate and the horizontal plate allows an operator to adjust the position of said L-shaped mounting arm in the yaw orientation and thereby adjust a yaw orientation of said motor; wherein said rotational attachment between said adjustable lower member and the motor consists of a multiplicity of circumferential slots on adjustable lower member and a multiplicity of screws to attach the motor to said adjustable lower member, wherein the slots are sized to allow the motor to rotate and the pitch of said motor to be adjusted up to seven degrees above or below parallel to said longitudinal axis, whereby the pitch the motor can be adjusted; wherein said adjustable clamp allows the user to adjust a rotational position of the axle to adjust a roll position of the motor; wherein said adjustable lower member includes a series of spaced attachment holes and wherein said vertical plate has a single set of alignment holes, whereby the adjustable lower member can be attached at different holes to alter a depth of the motor; wherein said axle includes an alignment screw threadedly attached to said axle, and said weldment includes an alignment slot disposed around said alignment screw to keep weldment aligned on said axle; wherein said axle includes a threaded locking hole, said weldment includes a locking slot aligned with said threaded locking hole and including a flat top rest on a top of said weldment and a flat bottom rest on a bottom of said weldment, and a threaded axle clamp configured to threadedly screws into said threaded locking hole, wherein said axle clamp can screw down onto said flat top rest to secure said weldment in position with said motor in the water, and wherein said axle clamp can screw down onto said flat bottom rest to secure said weldment in position with said motor out of the water; whereby when said adjustment arm and motor are locked into the down and in the water position the clamp and axle are close to the gunnel and thereby do not create any obstruction to the vessel, and wherein when said adjustable arm and motor are locked in the up and out of the water position, the profile of the vessel in the water is the same as when there is no motor. The device has a motor that is powered by a battery and controlled by a hand-held controller having a knob with a center detent wherein no power is supplied to the motor at said center detent, and wherein when the knob is turned clockwise forward power is supplied to the motor and the speed of the motor increases when the knob is turned further clockwise, and wherein when the knob is turned counterclockwise reverse power is supplied to the motor and the speed of the motor increases when the knob is turned further counterclockwise, thereby allowing the operator to control the forward and rearward movement as well as the directional control of the vessel. It is also possible that the device has two motors, wherein there is a device for mounting an electric motor attached to the side port gunnel and a device for mounting an electric motor attached to the starboard side gunnel, and wherein further said hand-held controller has two knobs, a port control knob to control the port motor, and a starboard control knob to control the starboard motor; whereby the operator can control the forward and rearward movement of the vessel as well as steer the vessel by independently altering the power and direction of the port and starboard motors.

BRIEF DESCRIPTION OF THE DRAWINGS

The accompanying drawings incorporated in and forming a part of the specification illustrate several aspects of the present disclosure, and together with the description serve to explain the principles of the present disclosure.

DETAILED DESCRIPTION OF THE INVENTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
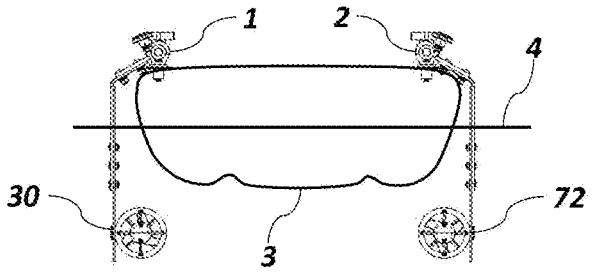
FIG. 1 is the rear view of the vessel with the motor mount assemblies affixed to the craft in the dual motor embodiment.

Referring now to the drawings and particularly to FIG. 1, which is a rear view of the vessel 3, there is shown a port 1 and starboard 2 motor mount assembly according to one embodiment, each applied to the vessel 3 in a typical usage position, where the uppermost end of each assembly 1 and 2 is fixed to the vessel 3 approximately at the gunnel, which is the top outer edge of the vessel as shown. The waterline 4 is shown to represent the boundary layer below which the motor is submerged when in the functional—extended in the water—position. Per the illustration it is evident that one of the distinguishing aspects of the invention, which is the independent port/starboard side motor mounting capability. It is important to note here that the disconnection between port and starboard assemblies allow independent motor mounting on either, or both sides to make possible a number of motor configurations independent of the design profile across the center of the vessel. Considering the myriad of configurations possible in hull design, it becomes increasingly difficult for any continuous, laterally spanning motor assembly design to be compatible with both concave and convex hull designs while still retaining a motor on each side; designs that laterally span the vessel must be adjustable in the lateral direction for various widths while also curving away from the vessel to accommodate concave form factors.

Figure 2:
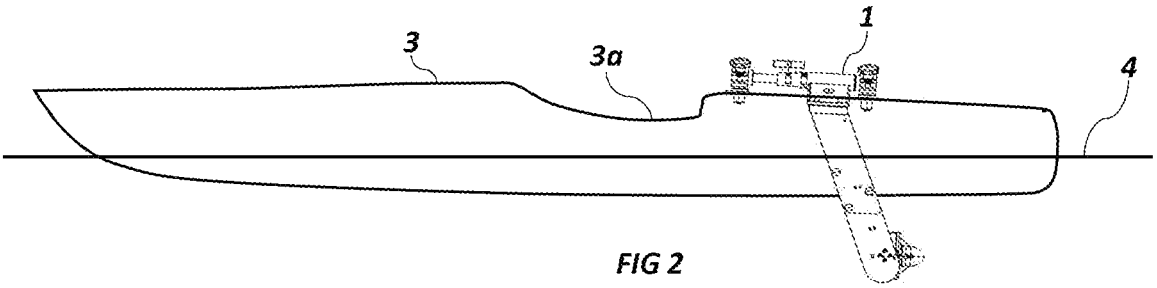
FIG. 2 is the left side view of the vessel with the motor mount assemblies affixed to the craft in the dual motor embodiment.

FIG. 2 shows the vessel 3 from the port side, outfitted with port side motor mount assembly 1, and the starboard side motor mount assembly 2 which is hidden from view behind motor assembly 1. FIG. 2 shows representations of the waterline 4, where motor mount assemblies 1 and 2 are configured to submerge the drive motors 30 & 72. From this view it can be seen that the motor mount assemblies 1 and 2, which share the same profile when viewed from the port side as in FIG. 2, place all the components towards the stern of the vessel just aft of the operator hull opening 3*a*, when configured in a typical application. It is important to note here that embodiments of the device may employ a location of the motor mount assembly fore/aft, or parallel to the operator position, and is not limited to a specific longitudinal position along the gunnel; the mounting position given here is merely of an illustration of an example configuration that is both convenient for the operator as well as functionally proficient. Finally, from FIG. 2, the lower portions of motor mount assemblies 1 and 2 are embodied here as being swept front to rear when viewed top to bottom in order to ease water disturbance while the vessel travels in the forward direction.

Figure 3:
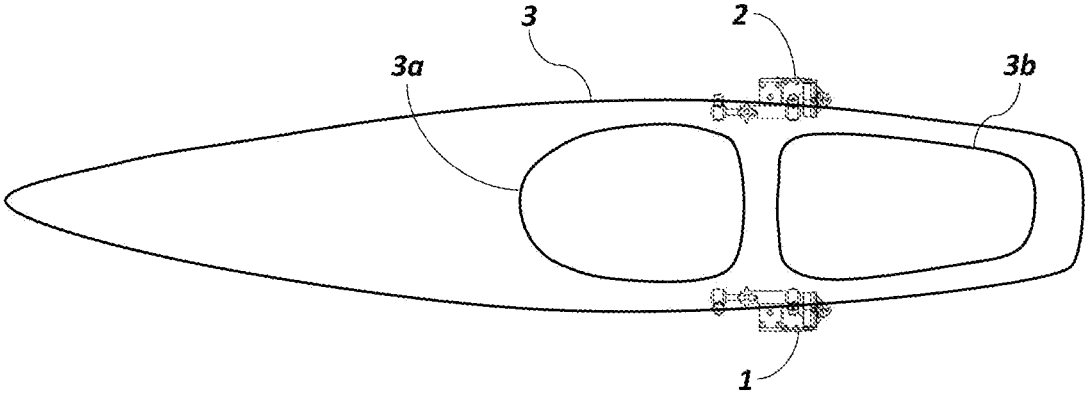
FIG. 3 is the top view of the vessel with the motor mount assemblies affixed to the craft in the dual motor embodiment.

FIG. 3 shows a top view of the vessel 3 outfitted with motor mount assemblies 1 and 2 fixed in a position of a typical embodiment, illustrating the compact form factor of the motor mount assemblies relative to the operator position in hull opening 3*a* In this configuration, the operator may experience an unobtrusive implementation of the device while fishing or otherwise, as motor mount assemblies 1 and 2 exist aft of their usual arm position at the rear of opening 3*a*. While in operation, motor mount assemblies 1 and 2 are lowered into the water and are out of the way of reel casting and retrieving items from the compartment 3*b* at the stern of the vessel. In addition, it can be seen from FIG. 3 that since motor mount assemblies 1 and 2 do not exist on a continuous frame spanning across the vessel, even greater operator mobility and storage options are achievable, as these assemblies occupy the slim profile approximately along the gunnel, deeming it unnecessary to intrude on either the storage compartment 3*b* or the operator opening 3*a*. Motor mount assemblies 1 and 2 are not physically connected in any way. This slim profile along with the positioning of the device is primarily a function of the novelty introduced into the mounting scheme, as it allows the operator to manually extend/retract the motors 30, 72 into the water for maintenance and clearing weeds from the props while also maintaining a low profile during powered operation. The details of the aforementioned novelty in mounting, extension into, and retraction out of the water are given in subsequent sections of this disclosure.

Figure 4:
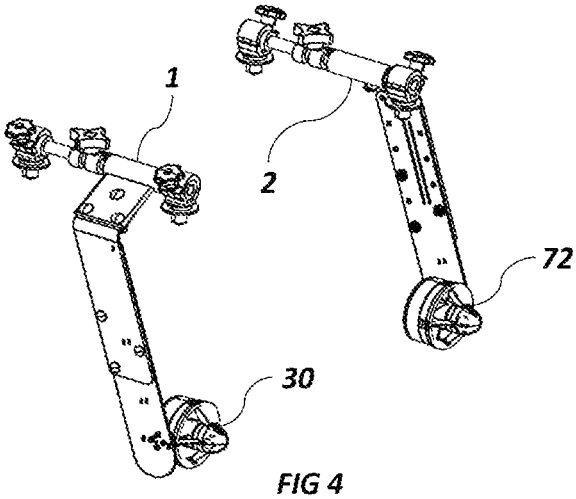
FIG. 4 is a rear perspective view showing only the dual motor mount assemblies, with no vessel present in the view.
Figure 5:
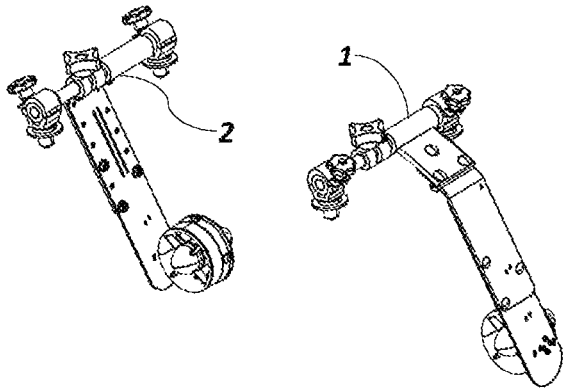
FIG. 5 is a front perspective view showing only the dual motor mount assemblies, with no vessel present in the view.

FIG. 4 shows a rear perspective view of the motor mount assemblies 1 and 2, separated from the vessel to present a more complete illustration of the device in the embodiment used herein. FIG. 4 shows the overall form of the port and starboard side mirrored assemblies, which provides a base reference to the more detailed descriptions below. FIG. 5 shows a front perspective view of the motor mount assemblies 1 and 2, with the vessel removed, to present a more complete illustration of the device.

Figure 6:
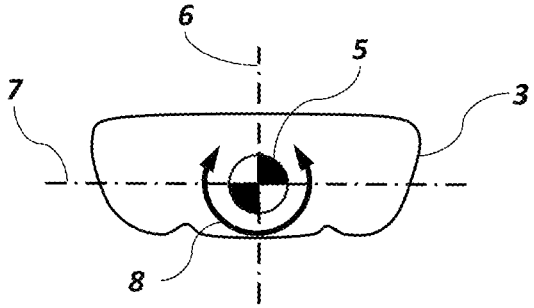
FIG. 6 is a rear view of the vessel, with references to the center point, roll direction, lateral axis, and vertical axis.

To clearly define the use of the terminology "vertical axis", "lateral axis", and rotational motion described herein as "roll", FIG. 6 is given. FIG. 6 shows the rear view of the vessel 3, where element 5 represents the theoretical center point of mass of that vessel. Axis 6 and 7 are shown to represent the vertical and lateral axis, respectively, where 6 and 7 pass through the center point 5, oriented exactly 90 degrees from one another. Element 8 shows the potential rotational movement of vessel 3 about center point 5, known throughout this document as "roll". The definition of "roll" is generally universally applied to waterborne vessels as well as aircraft in the same manner and description as that given in FIG. 6. "Roll" means to roll around the longitudinal axis 9.

Figure 7:
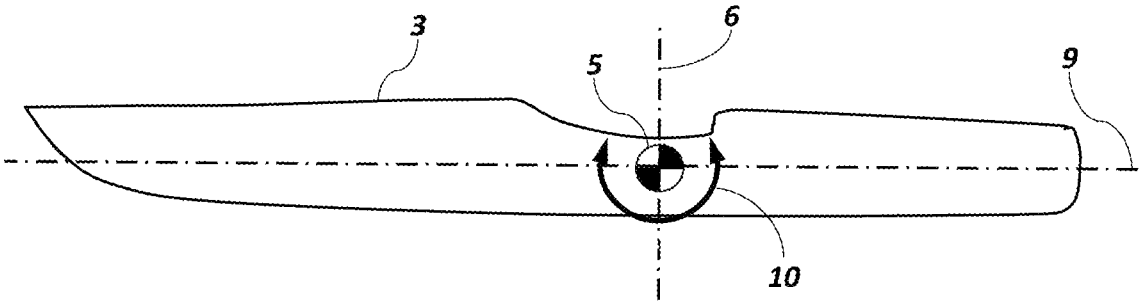
FIG. 7 is a left side view of the vessel, with references to the center point, pitch direction, longitudinal axis, and vertical axis.

For the purposes of clearly defining the use of the terminology "longitudinal axis", and rotational motion described herein as "pitch", FIG. 7 is given. FIG. 7 shows the port side view of the vessel 3, where element 5 represents the theoretical center point of mass of that vessel. Axis 6 and 9 are shown to represent the vertical and longitudinal axis, respectively, where 6 and 9 pass-through the center point of mass 5, oriented exactly 90 degrees from one another. Element 10 shows the potential rotational movement of vessel 3 about center point 5, known throughout this document as "pitch". The definition of "pitch" is generally universally applied to waterborne vessels as well as aircraft in the same manner as that given in FIG. 7. "Pitch" means that the front of the vessel goes up or down.

Figure 8:
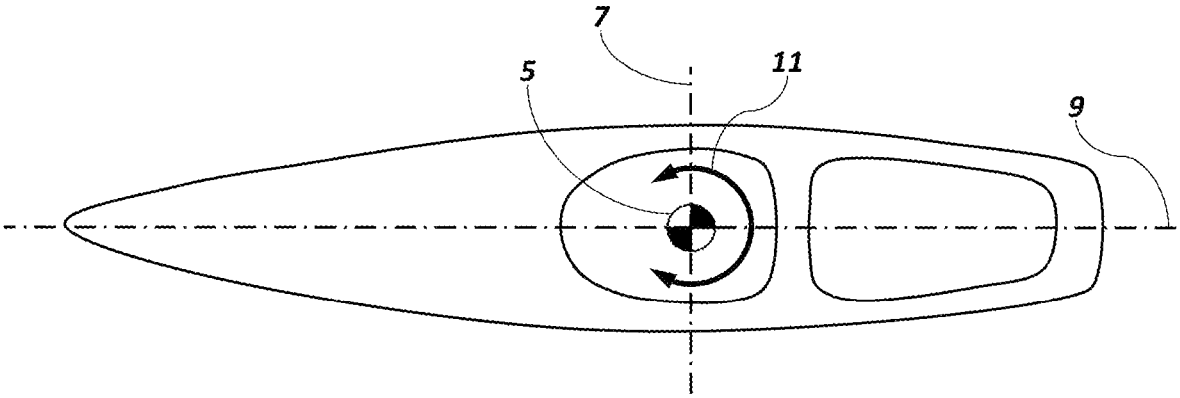
FIG. 8 is a top view of the vessel, with references to the center point, yaw direction, longitudinal axis, and lateral axis.

For the purposes of clearly defining the use of the terminology "yaw" described herein, FIG. 8 is given. FIG. 8 shows the top view of the vessel 3, where element 5 represents the theoretical center point of mass of that vessel. Axis 7 and 9 are shown to represent the lateral and longitudinal axis, respectively, where 7 and 9 pass through the center point of mass 5, oriented exactly 90 degrees from one another. Element 11 shows the potential rotational movement of vessel 3 about center point 5, known throughout this document as "yaw". The definition of "yaw" is generally universally applied to waterborne vessels as well as aircraft in the same manner as that given in FIG. 8. "Yaw" means the front of the vessel moves left or right off of the longitudinal axis.

Figure 9:
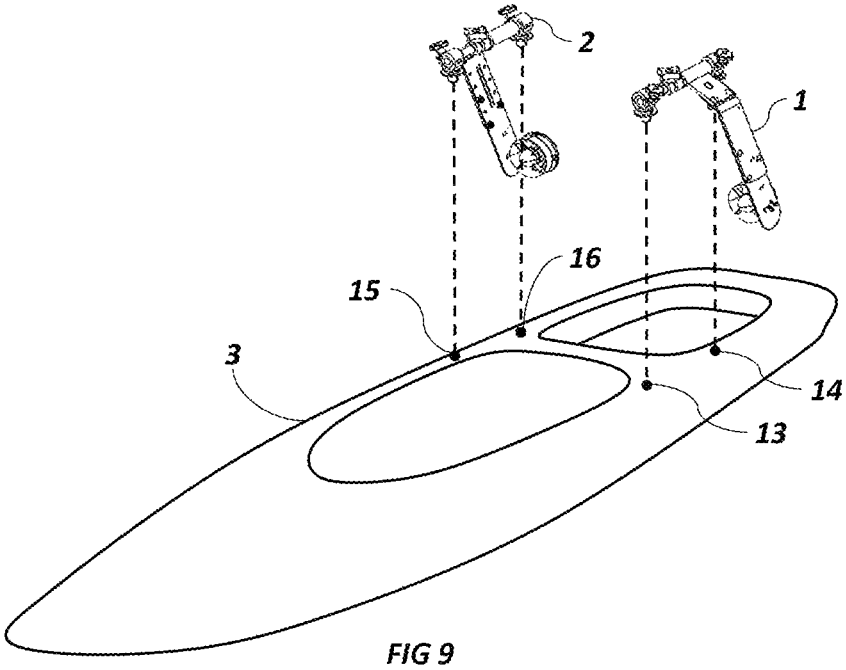
FIG. 9 is a perspective view of the dual motor embodiment, illustrating the vessel and a reference to the four mounting points of the dual arm assemblies.

FIG. 9 illustrates typical positions for mounting motor assemblies 1 and 2, onto vessel 3, whereby two holes at locations 13 and 14, on the port side of the vessel, are drilled for accepting two (2) well nuts 49 which are part of motor mount assembly 1. Hole 13 is the forward port mounting hole and hole 14 is the rearward port mounting hole. Conversely, the starboard side of the vessel accepts motor mount assembly 2 by way of two (2) holes drilled at locations 15 and 16. Hole 15 is the forward starboard mounting hole and hole 16 is the rearward starboard mounting hole. Both the port and starboard well nut attachment points 13-16 are generally along the gunnel of vessel 3, each mounted at the most proximal and most distal ends of motor mount assemblies 1 and 2 from FIG. 9, and with each intended to closely approximate the longitudinal axis of the vessel in all applications in order that the least possible amount of stress is given to the hull by the torque from the motor, which acts about the center point 5 from FIG. 7 in the pitch direction 10. The attachment points of motor assemblies 1 and 2 at their proximal and distal ends along the gunnel is one of the key design features making the device described herein unique in function when compared to other motor mount devices for kayaks, paddle boards, canoes, and rowboats, as this design utilizes the most leverage possible by way of the frame to prevent rotation of the motor assembly in the direction of pitch from FIG. 7, being only limited by the longitudinal span of motor assemblies 1 and 2, which can be altered, by design, at will to accommodate various motor outputs.

Figure 10:
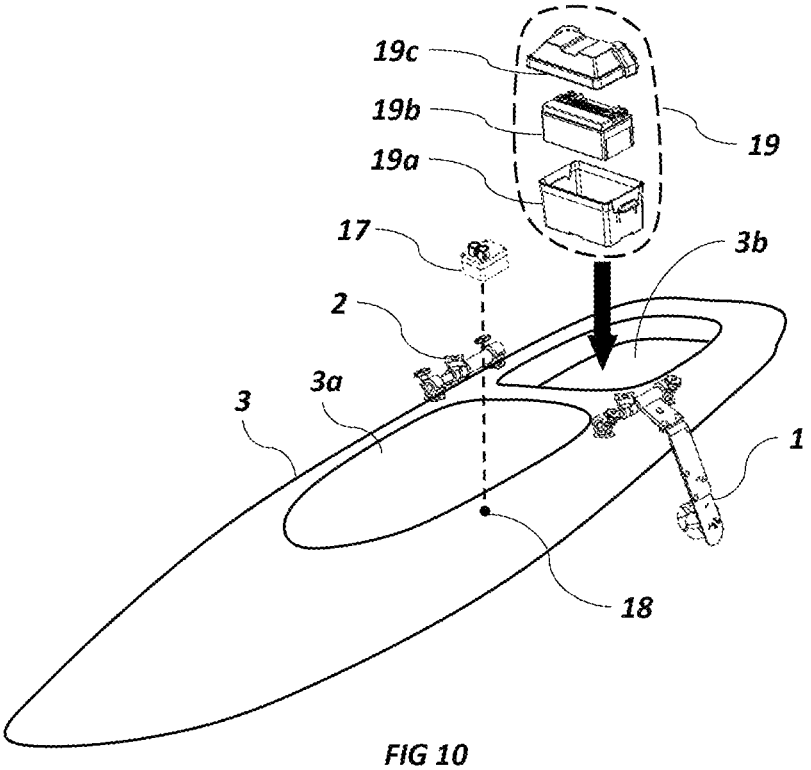
FIG. 10 is a perspective view of the affixed dual motor embodiment, with a representative hand controller and battery accessories placement.

FIG. 10 shows the dual motor embodiment of the device with motor mount assemblies 1 and 2 fixed to the vessel 3 in their normal operating positions relative to typical embodiment of the auxiliary equipment necessary in the implementation of the device. From FIG. 10, the electronics/power generation accessory 19 is shown to be placed in what is a standard designed kayak 3, containing a rear cargo area 3*b*, where 19 contains the necessary electronics to convert DC battery power into electromotive force applied to the motor. More details of the electronics components are covered below, but in FIG. 10, accessory 19 is made up of a battery box 19*a*, to which is attached inside all manner of electrical devices as described below. Battery 19*b* is meant to be carried in battery box 19*a*, along with most other sensitive electronics to both package the accessories efficiently so they are easily handled by an operator, and to protect both the battery and the electronics package from water and/or breakage during portage and general hauling/transporting. Finally, accessory 19 is made water resistant with a lid 19*c*, providing a snap on, splash proof cover for the battery and associated electronics. It is important to note here that while the preferred embodiment places accessory 19 into cargo hold 3*b*, this accessory is meant to be modular in design relative to the motor mount assemblies 1 and 2, and as such, may be placed about the vessel in all manner of configurations, and wherever is most convenient for the user. The result of efficient packaging of accessory 19 yields a design conducive to quick removal/application of the accessory to the vessel when converting the vessel from a human powered state to the electrically powered state, and vice-versa. Finally, in keeping with quick application/removal of accessory 19, it should be stated here that the attachment of accessory 19 to the vessel 3 is intended to be in accordance with and adherence to all state, local, and federal coast guard regulations pertaining to securing a battery power source to a waterborne vessel. The manner and type of fastening device used to retain accessory 19 is assumed to be non-permanent, in-keeping with the design philosophy of convertibility of the vessel from electric power to human power in a relatively easy manner for the average user, and using no tools.

FIG. 10 also illustrates a preferred embodiment of the hand controls accessory 17, and its placement on the vessel relative to motor mount assemblies 1 and 2, and the operator cockpit 3*a*. Here, hand controller 17 is intended to be slim, easy to handle by a single operator, and easily installed and removed from the vessel with no tools or special equipment. The operator hand controller 17 is placed generally onto the gunnel of the vessel 3 (or any other location convenient to use by an operator) by plastic Velcro®, or other temporary means, and provides a single, set-position lever for each motor incorporated into the system. The purpose of this accessory is to provide full control of all drive motors of the system. In the embodiment herein, and as described below, there are two knobs which controls the port and starboard side motors. In the preferred embodiment the port knob 59 closest the port side of the hand controller 17 serves as throttle input to the port side motor 30, while the starboard knob 58 closest the starboard side of the hand controller 17 serves as the throttle input for the starboard motor 72. The hand controller 17 is water resistant. More detail of the hand controls assembly 17 is given below.

Figure 11:
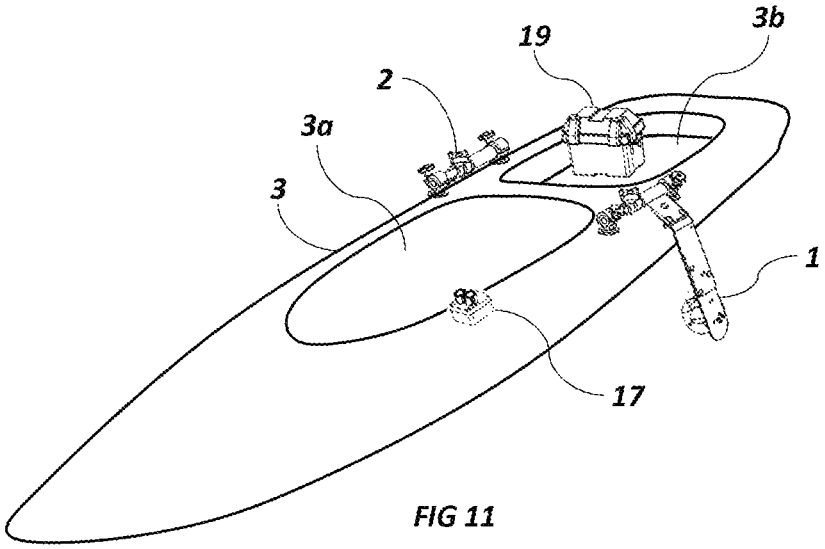
FIG. 11 is a perspective view of the vessel with representative positioning of all major components mounted in their functional locations.
Figure 12:
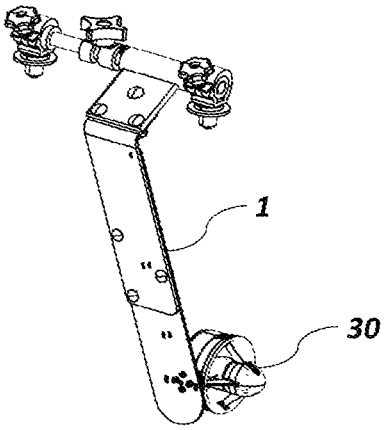
FIG. 12 shows a perspective view of one (left-handed) motor mounting assembly.

FIG. 11 illustrates the preferred embodiment of the invention with all major components fixed in their respective operational positions on the vessel 3. Here it can be seen the relationship between motor mount assemblies 1 and 2 relative to hand control assembly 17, which is easily accessible by an operator from the cockpit 3*a*. The electrical/battery accessory 19, is shown located in a typical position within the cargo hold 3*b*. FIG. 12 shows the port side motor mount assembly 1 to show the general structure of the motor mount assemblies 1 and 2. Note here that the starboard side motor mount assembly 2 is a mirror image of this port side motor mount assembly 1.

Figure 13:
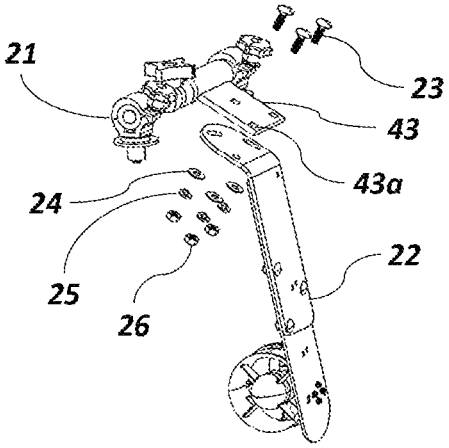
FIG. 13 shows a perspective, partially exploded view of a single, left-handed motor mount assembly showing two major sub-assemblies—an arm and a hinge—with joining hardware.

FIG. 13 is an exploded view of the motor mount assembly 1 separated into its two major sub-assemblies including the hinge assembly 21 and the adjustable arm 22. Here, three (3) carriage bolts 23 are accepted into three (3) through holes 43*a* that are incorporated into a component 43*c* on hinge assembly 21. Three (3) holes 43*a* in component 43 align in with three (3) corresponding through holes in adjustable arm 22 and are backed with both three (3) washers 24 and three (3) locking washers 25 to prevent loosening. Finally, three (3) nuts 26 are used to tighten sub-assemblies 21 and 22 together. Hinge assembly 21 features the components used to attach the motor mount 1 to the vessel 3, while also incorporating the rotatable member (the axle 40) used to raise and lower the adjustable arm 22 into and out of the water during operation. The details of the components used in hinge assembly 21, along with exploded views, are set out below. Adjustable arm 22 serves to rigidly hold the motor 30 and is designed to incorporate adjustability of the motor position and direction in terms of the vertical axis 6, pitch direction 10, and in the yaw direction 11. Details of the adjustable arm 22, its adjustability, and all its components are below.

Figure 14:
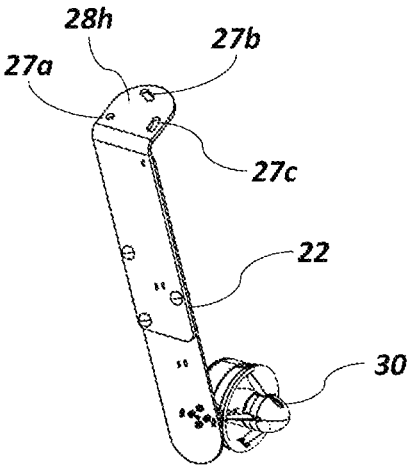
FIG. 14 is a perspective view of the adjustable arm sub-assembly with indicated points of attachment and adjustability.

FIG. 14 details the attachment hole features of adjustable arm 22. Bolts 23 protrude through holes 27*a*, 27*b*, and 27*c*, which are incorporated into the horizontal plate 28*h* of the upper L-shaped arm 28 of arm assembly 22. These three mounting points join assembly 22 to assembly 21 and ultimately to the hull of the vessel 3. The attachment point between hinge assembly 21 and the adjustable arm 22 is adjustable. A bolt through hole 27*a* is used as a pivot point for the two slotted holes 27*b* and 27*c*, where the slots of holes 27*b* and 27*c* exhibit a radius with a center point at the center of hole 27*a*. This three-hole configuration allows arm assembly 22 to rotate 13.3 degrees total (in the preferred embodiment), primarily in the yaw direction, during attachment to hinge assembly 21, prior to tightening nuts 26. Holes 27*b* and 27*c* are slotted to allow rotation such that, independent of the mounting accuracy of hinge assembly 21 to the vessel, adjustable arm 22 may be adjusted so that the face of the drive motor 30 (or 72) is as close as possible to perpendicular with the longitudinal axis 9 of the vessel 3, so that the thrust of the motors 30 and 72 will be parallel with the longitudinal axis 9. The resultant function of the three mounting holes 27*a*, 27*b*, and 27*c*, is to make possible forward-facing motor positioning independent of the curvature of the gunnel to which the motor mount assembly 1 and/or 2 is attached.

Figure 15:
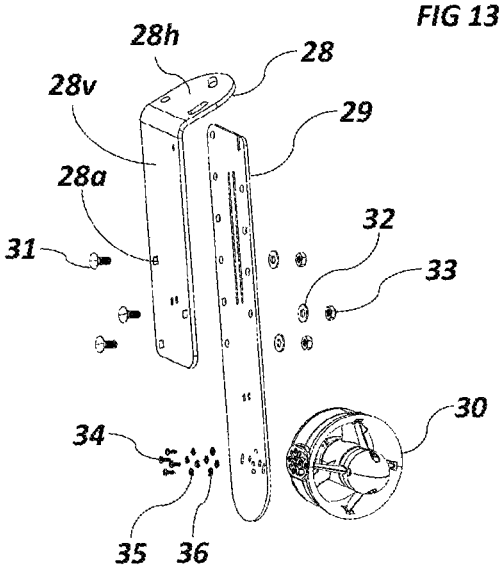
FIG. 15 is a perspective exploded view of the adjustable arm sub-assembly.

FIG. 15 illustrates an exploded view of adjustable arm 22, providing a break-down of all components. Adjustable arm 22 is made up of an L-shaped arm 28, and an adjustable lower member 29. L-shaped arm 28 has a vertical plate 28*v* and a horizontal plate 28*h*. In typical operation the horizontal plate 28*h* is generally, though not exactly, horizontal to the surface of the water, and vertical plate 28*v* is vertical and either extending downwardly into the water, or upwardly out of the water. In the preferred embodiment the horizontal plate 28*h* is actually angled upwardly a bit, as seen in FIG. 15, meaning that the L-shaped arm 28 is not a perpendicular L, more of an angled L. In the preferred embodiment the arm is angled at 30-degrees, as is the weldment attachment plate 43*c* to which it is attached. Three (3) carriage bolts 31 penetrate vertical plate 28*v* through three (3) square holes 28*a* to attach it to the adjustable lower member 29, which has holes that are concentric with three (3) through holes 28*a*, which also accept carriage bolts 31. Installed onto carriage bolts 31, three (3) washers 32 are used under three (3) nylon locking nuts 33, clamping adjustable lower member 29 rigidly to the vertical plate 28*v* of the L-shaped arm 28 when tightened. A motor 30 is then attached to the bottom of the adjustable lower member 29 with four (4) machine screws 34, where (4) flat washers 36 and (4) locking washers 35 are used between member 29 and machine screw 34 to prevent aluminum deformation and loosening. As described in more detail below, adjustable lower member 29 adjustably attaches to the vertical plate 28*v* of the L-shaped arm 28 to provide up to 4.5 inches of vertical adjustability of the motor position relative to the vessel 3, in the preferred embodiment. In addition to this vertical adjustability, adjustable lower member 29 provides slots for +/−7.0 degrees of rotational adjustment of the motor position in the roll direction. Details of the adjustability exhibited by member 29 with regards to the vertical position and roll angle of the motor are given below.

Figure 16:
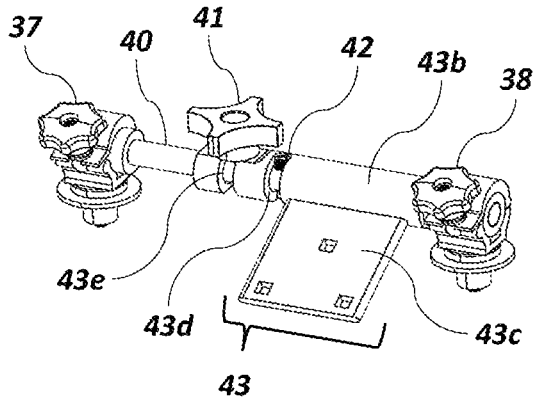
FIG. 16 is a perspective view of the hinge sub-assembly.

FIG. 16 shows a more detailed view of the components of the hinge assembly 21 to illustrate the role the hinge assembly 21 plays in both holding the adjustable arm 22 and fixing it into the extended or retracted positions. Distal clamp assembly 37 and proximal clamp assembly 38 are used to hold a fixed axle 40 rigidly to the vessel 3. This axle 40 provides the axis of rotation for the adjustable arm 22, and is aligned primarily along the longitudinal axis 9 of the vessel 3. A weldment 43 having an attachment plate 43*c* and a rotating cylinder 43*b* that slides onto and rotates around the axle 40. The rotating cylinder 43*b* is longer than the attachment plate 43 *c*, and includes two slots, alignment slot 43*d*, and lock slot 43*f*. The attachment plate 43*c* attaches to the horizontal plate 28*h* of the adjustable arm 22. The weldment 43 is the interface between the axle 40, and adjustable arm 22. Important to note here, and fundamental to the reliable function of the disclosed invention, is the orientation of axle 40, where it exists as a low-profile feature along the gunnel of the vessel 3. This configuration is made possible only by implementation of the unique design of clamps 37 and 38. In order to retain the weldment 43 in the desired position on the axle 40 for both extension and retraction of adjustable arm 22, an alignment hole 40*a* is drilled and tapped to accept a machine alignment screw 42, where the head of the machine screw 42 rides in alignment slot 43*d* of the weldment 43, thus preventing movement of weldment 43 along the axle 40. Alignment slot 43*d* is machined into element 43*b* to the extent to allow a sufficient degree of rotational movement of weldment 43 when alignment screw 42 is installed, which, in the present embodiment is approximately 180 degrees of total rotation. It is within the conception of the invention that there may be a variety of slot geometry sufficient to allow the adjustable arm 22 to move into and out of the water. Finally, a lock slot 43*e* in member 43*b* is machined to accept a threaded stud handle 41, and wherein the threaded stud handle 41 is screwed into a threaded lock hole 40*b* that is sunk and threaded into axle 40. The threaded stud hand 41 is screwed into hole 40*b* to retain weldment 43 against axle 40, and consequentially adjustable arm 22 into a fixed position of either extension into, or retraction from, the water. Details of the means which threaded stud handle 41 used to rigidly fix weldment 43 in place is given below.

Figure 17:
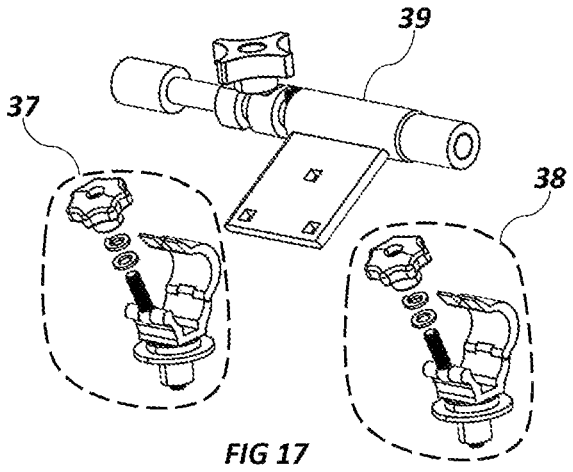
FIG. 17 is a perspective of the hinge sub-assembly with a detail of the two clamps.

FIG. 17 illustrates how clamps 37 and 38 function to accept axle 40 for simple, quick, and easy removal and re-installation of the drive motors 30 & 72. Here the clamps 37 and 38 are shown in an open position to accept axle 40, retaining it at each end. FIG. 17 represents the separation of motor mount assembly 1 into the components which are intended to be a permanent fixture of the vessel (clamps 37 and 38) from the remaining components making up assembly 1.

Figure 18:
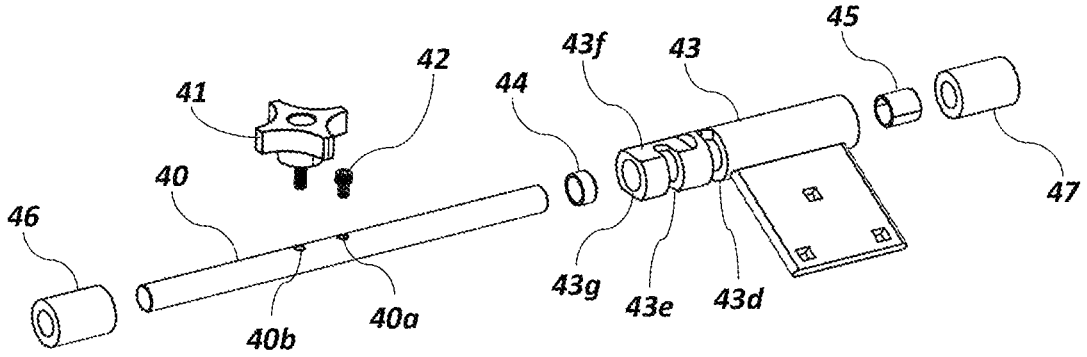
FIG. 18 is an exploded perspective view of the axle assembly.

FIG. 18 shows an exploded view of axle 40 and axle assembly 39. In the preferred embodiment the axle 40 is a steel rod 10 ½ inches long. Here, the rotating cylinder 43*b* is fitted internally on its proximal and distal ends with nylon bearings 44 and 45, respectively. Weldment 43, along with bearings 44 and 45, makeup the rotatable portion of axle assembly 39 to which the adjustable arm 22 is attached. The nylon bearings are incorporated into the weldment 43 to prevent wear when extending and retracting the motors 30 & 72 into and out of the water. Weldment 43 and its bearings 44 and 45 are fitted to axle 40, where axle member 40 is cross drilled and tapped to accept a machined alignment screw 42 along with the threaded stud handle 41, which are screwed into alignment slot 43*d* and lock 43*e* in weldment 43. Alignment screw 42 is the primary means of preventing the weldment 43 (and consequentially the adjustable arm 22) from sliding on the axle 40, while also providing the rotational stop for the extended and retracted motor positions. Threaded stud handle 41 locks the weldment 43 into a fixed position by securing against the top flat surface 43*f*, which locks the adjustable arm 22 in the extended—in water—position, or the bottom flat surface 43*g*, which locks the adjustable arm 22 in the retracted—out of water—position. The top flat surface 43*f* and bottom flat surface 43*g* are on opposite sides of the end of the rotating cylinder 43*b*. Finally, nylon bearings 46 and 48 are externally press-fitted to axle 40 at its proximal and distal ends, respectively, providing an interface for clamping by assemblies 37 and 38.

Figure 19:
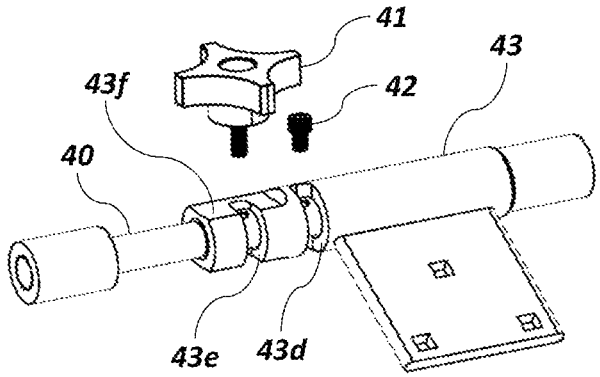
FIG. 19 is a partially exploded perspective view of the axle assembly.

FIG. 19 shows the weldment 43 on the axle 40, with the threaded stud handle 41 and alignment screw 42 removed to illustrate their role in interfacing to both weldment 43 and axle 40 to properly constrain rotatable weldment 43 in the extended or retracted motor positions. In this view, it may be seen more clearly alignment slots 43*d* and lock slot 43*e*, where each vertically oriented flat wall of alignment slot 43*d* is used to stand off on the head of alignment screw 42, creating the primary means of retention of weldment 43 on the axle 40, and where alignment screw 42 is meant to bed-in at each end of the alignment slot 43*d* to create a primary rotational stop in the extended and retracted motor positions. In the preferred embodiment alignment slot 43*d* is cut 180 degrees into the rotating cylinder 43*b* which allows the weldment 43 to rotate 180 degrees on the axle 40. Slot 43*e* is machined larger than the threaded portion of threaded stud handle 41 to create clearance between threaded stud handle 41 and the walls of the lock slot 43*e*. At such time that the operator moves the motor into or out of the water, threaded stud handle 41 is loosened, which allows the weldment 43 to rotate on the axle 40. After rotating the motor mount assembly into the desired position, the threaded stud handle 41 may then be tightened, thus clamping the axle 40 securely into place. There is a flat bottom on the handle portion of the threaded stud handle 41 that acts as a clamp to hold the axle 40 into position, and when screwed tight the flat bottom portion presses against the flat surfaces 43*f* or 43*g*. When the motor is in the extended in water position the threaded stud handle 41 screws down against the top flat surface 43*f* to lock the weldment 43 into position, and when the motor is in the retracted, out of water position the threaded stud handle 41 screws down against the bottom flat surface 43*g* to lock the weldment 43 into position.

Figure 20:
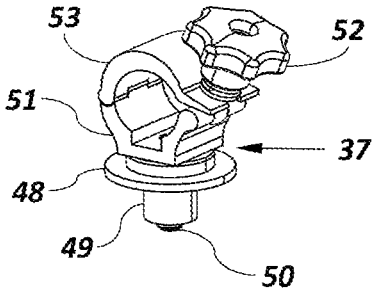
FIG. 20 is a perspective view of one of the clamps.
Figure 21:
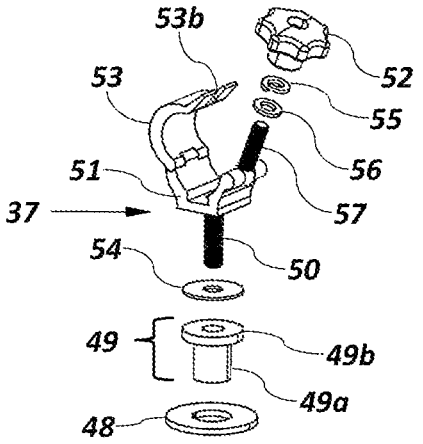
FIG. 21 is an exploded perspective view of one of the clamps with the mechanism by which the clamp attaches to the hull.

FIG. 20 shows a clamp 37 in the uninstalled state, and in the closed position to identify the major components. (Clamp 38 is identical.) A threaded stud 50 is permanently attached to the lower clamp component 51. Threaded stud 50 protrudes through an oversized washer 48 and can then be screwed into the well nut 49. Upper clamp component 53 pivots relative to lower clamp portion 51 during removal and installation of the motor assembly and is tightened against bearing 46 using handle 52. All four clamps 37 are identical, varying only in their placement on the vessel. FIG. 21 is an exploded view of the clamp 37. The oversized washer 48 accepts the well nut 49. A well nut is well known in marine applications. The well nut 49 is a continuous deformable rubber member sized such that its lower portion 49*a*, fitted with a threaded metal insert, fits just inside the inner diameter of oversized washer 48. The upper portion 49*b* of well-nut 49 is sized larger than the inner diameter of oversized washer 48 and is meant to prevent well nut 49 from slipping all the way through oversized washer 48 when the clamp 37 is installed to the vessel 3. A flat washer 54, is placed atop well nut 49 to reduce friction between the lower clamp component 51 and upper well-nut portion 49*a* when threaded stud 50 is screwed into the well nut 49 during installation. Threaded stud 50 is permanently attached to the lower clamp component 51 such that threaded stud 50 and lower clamp 51 behave as a single component. The upper clamp component 53 hinges about lower clamp component 51 at its distal end to allow the axle 40 of the motor assembly 1 to be accepted onto the vessel 3 during installation and removal. During installation the well nuts 49 are inserted into the holes 13, 14, 15, & 16 on the gunnels of the vessel 3 to mount the clamps 37 onto the vessel 3. Then the axle assembly 39 is placed into an open clamps 37. Next, the upper clamp assembly 53 rotates from its distal end to meet stud 57 where stud 57 fits into a slot 53*b*. Upon rotation of upper clamp component 53 down to meet stud 57, a flat washer 56 and a locking washer 55 are placed onto stud 57, where an internally threaded handle 52 is tightened to onto stud 57, retaining upper clamp component 53 to lower clamp component 51 at its proximal end to secure the axle 40 into the clamp 37, and to secure the motor mount assemblies 1 and 2, to the vessel 3.

Figure 22:
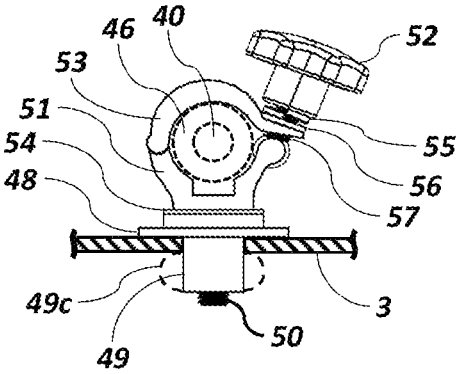
FIG. 22 is a cross sectional side view of the clamp with axle as attached to the vessel.

Clamp 37 is shown in FIG. 22 along with a cross section of the hull of the vessel 3 to illustrate the mechanism through with the entire motor mount assembly 1 (or 2) is attached to the hull. Here, oversized washer 48 is placed with its hole concentric with the hole 13, 14, 15 & 16, drilled into the hull of the vessel 3. Well nut 49 is placed through both the oversized washer 48 and the hole in hull 3. Atop the well-nut 49 is placed a washer 54. The threaded stud 50 is screwed into the threaded portion of well-nut 49, causing well nut 49 to expand at its lower portion 49*a*, thus filling the hole and securing the clamp 37 to the vessel 3. These types of well nuts are well known in the marine arts. The upper clamp component 53 is opened to accept an axle assembly 39, and once the axle 40 is in place the upper clamp component 53 is rotated down and the is tightened clockwise onto stud 57 causing nylon bearing 46 along with axle 40 to be clamped between upper and lower clamp components 51 and 53, thereby fixing axle assembly 39 and axle (and in turn, the entire motor mount assembly 1) rigidly to the vessel 3.

Figure 23A:
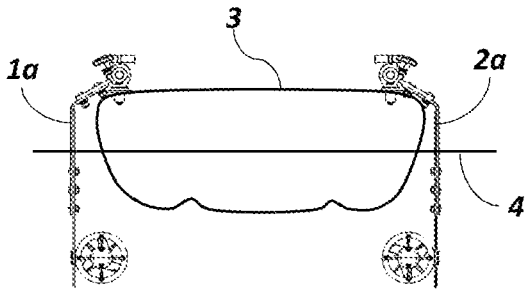
FIGS. 23*a* and 23*b* shows a rear view of the vessel, with FIG. 23*a* showing the motors in the extended (in the water) position, and FIG. 23*b* showing the motors in the retracted (out of the water) positions.
Figure 23B:
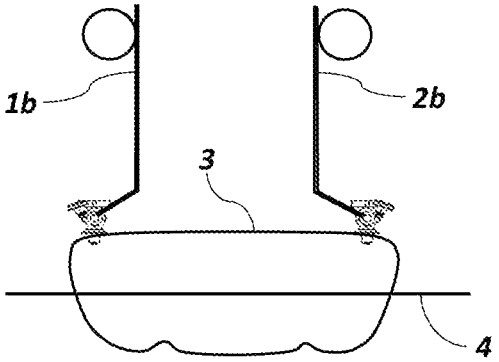

FIGS. 23*a* and 23*b* are rear views of the vessel showing the motor mounts 1 and 2 in the extended—or in the water—position in FIG. 23*a*, and in the retracted—or out of the water—position in 23*b*. FIG. 23*a* is viewed from the stern of the vessel 3, relative to the waterline 4 where 1*a* and 2*a* represent the port and starboard motor mount assemblies, respectively, when the motors are extended below the waterline 4 in the functional position. Note that in FIG. 23*a*, the motors are mounted inboard of their vertical support structure to both reduce the overall horizontal profile of the total system, and also to provide an increased amount of impact protection while turning and/or pivoting in place. The second lockable position of the motor mount assemblies is retracted position, shown in FIG. 23*b*. From these profiles it can be observed that inherent to the design and novelty of the invention is the low-profile nature of the motor mounting device when the adjustable arm 22 is lowered and the motors 30 & 72 are in the water. The flat stock material used in the construction of the mounting device gives added strength in the direction of torque application and maintains a very slim side-to-side profile when in the extended position, thus allowing the vessel to move unobstructed through tight spaces with minimal added width. Additionally, the profile of the device when in the retracted (out of water) position results in an underwater and side-to-side profile equal to the original, unequipped vessel. The slim retracted profile becomes essential when draft conditions are sufficiently low to necessitate retraction of the motors 30 and 72 from the water to pass low-clearance underwater obstacles. It's important to note that compared to other motor mounting devices for small non-powered vessels, such as canoes, kayaks, and rowboats, which widen the overall profile of the vessel even when retracted from the water, this invention was designed such that on-the-fly reconfiguration from the extended to retracted position serves to return the vessel to its original draft and side clearance condition so that no compromise in clearance is made.

As can be seen in FIG. 23*a*, the adjustable attachment arms 22 are offset from the side of the vessel 3 when the motors are in the water. This is the result of the geometry of the weldment 43 attachment plate 43*a*, and how it is attached to the horizontal plate 28*h* of the adjustable attachment arm 22. In the preferred embodiment the weldment attachment plate 43*c* and the horizontal plate 28*h* of the L-shaped attachment arm 28 are both angled at 30 degrees, which means that when connected and in the extended in the water position, the attachment plate 43*c* angles down and away from the axle 40 an moves the adjustable arm 22 away from the hull of the vessel 3. This attachment places the adjustable attachment arm 22 roughly four inches, in the preferred embodiment, away from the axle 40, which is attached to the gunnel of the vessel 3. Because of this configuration, the motor mounts 1 and 2 have a low profile above the gunnel of the vessel 3. As seen in FIG. 23*a*, the motors 30 and 72 are positioned inside of the adjustable arms 22 and this under the hull of the vessel 3. This allows the operator of the vessel 3 to be able to visually keep the motors for snagging or hitting any visible submerged objects. When the motor mounts 1 and 2 are reconfigured and the motors are pulled out of the water, as shown in FIG. 23*b*, the motor mounts 1 and 2 sit inside the horizontal footprint of the vessel 3. This means that, when the motors are retracted, the vessel 3 will have the same profile in the water as if it were operating without any motors attached.

Figure 24:
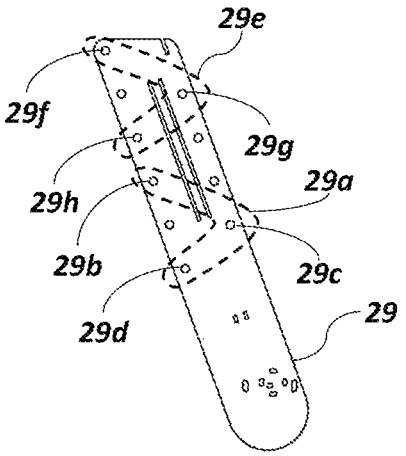
FIG. 24 is a side view of the lower portion of the adjustable arm with the mounting features that provide vertical adjustability of the motor.

FIG. 24 shows the built-in vertical adjustability of the motor mounting device incorporated into the connection between the L-shaped upper attachment member 28 and the adjustable lower member 29, as mentioned above. As stated previously, the goal of the invention is to be capable of being applied to a very broad range of vessels, including kayaks, row boats, canoes, and paddleboards. In keeping with this goal, the adjustable lower member 29 includes a series of holes that create four potential mounting positions for adjustable lower member 29 onto L-shaped upper attachment member 28, thus creating the potential for up to 4 different mounting heights of the drive motors 30 and 72 relative to the vessel 3. The three-hole pattern, 29*a*, shown in FIG. 24, utilizes individual holes 29*b*, 29*c*, and 29*d*, resulting in the shallowest mounting depth of the motor. Utilization of the three-hole pattern 29*e* represents the deepest mounting depth of the motor, and employs holes 29*f*, 29*g*, and 29*h* for fixing. In the preferred embodiment, the vertical distance, as measured perpendicular from waterline 4 from FIGS. 23*a* and 23*b*, between hole patterns 29*a* and 29*e* is 4.5 inches, which creates a total vertical adjustability of 4.5 inches. Hole pattern 29*a* is intended to cover a motor depth appropriate for 80-90% of commercially available kayaks, and hole pattern 29*e* is meant to accommodate the highest profile kayak commercially available. In between hole patterns 29*a* and 29*e* are two intermediate three-hole mounting positions, each spaced 1.5 vertical inches from one another. These intermediate positions give the user a reasonable degree of adjustability in mounting options to allow the minimum draft clearance possible for their application without motor cavitation under full throttle (too shallow of a motor depth).

Figure 25:
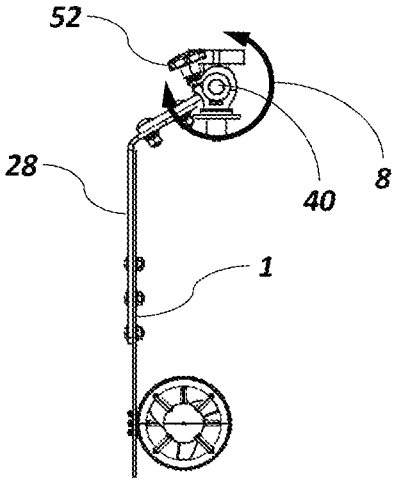
FIG. 25 is a rear view of the left side motor mount assembly illustrating the manner which the motor position may be adjusted in the roll direction on the axle.

FIG. 25 illustrates the mechanism by which the motor mount assembly 1 is adjusted in the direction of roll 8 to the desired operating position. During installation of the motor mount assembly 1, the axle assembly 39 from FIG. 17 is received at both the distal and proximal ends by clamps 37 and 38. Prior to final tightening of the clamps 37 and 38 onto axle assembly 39 using knob 52 the operator rotates the motor mount assembly 1 such that the L-shaped upper attachment member 28 is in the desired orientation. In the preferred embodiment, that position is normally vertical (or straight down), to align with the vertical axis 6 of the vessel 3. However, in some configurations the operator may want to motors 30 and 72 to be offset slightly from the hull of the vessel 3 for a variety of reasons, including moving through shallow waters. In that situation the motor mount assemblies 1 and 2, can be secured with the L-shaped upper attachment member 28 off of vertical. Once in the desired position, an operator tightens two handles 52 on the clamps 37 to secure the desired roll position of the motor mount assembly 1 relative to the vessel 3.

Figure 26:
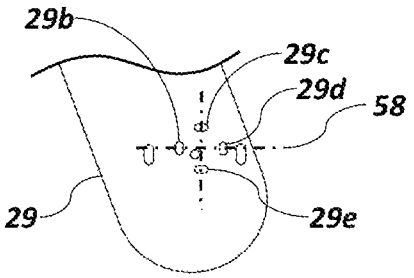
FIG. 26 is a detail of the motor positioning mount showing the mounting features that allow pitch adjustment of the motor.

FIG. 26 is a detailed illustration of slotted holes located at the bottom of the adjustable lower member 29 which allows for the pitch adjustment of the motors 30 and 72. In keeping with the adaptable and widely applicable nature of the device described herein, full adjustability for various vessels must also include allowances for motor pitch. To achieve pitch adjustability, the slotted mounting holes for a motor 30 are in a circular pattern, where the slotted holes 29*b*, 29*c*, 29*d*, and 29*e* are slotted in a circumferential direction about center point 58. Attachment of motor 30 to adjustable arm 29 is with machined screws 34 protruding through slotted holes 29*b*, 29*c*, 29*d*, and 29*e*. The slots allows for +/−7.0 degrees of rotational pitch adjustment of the motor 30 about center point 58, meaning 7 degrees up or down from horizontal, for a total 14 degrees of rotational adjustment. Note here that it is possible to increase the opening of the slotted holes to potentially allow for a greater degree of rotation than 14 degrees, but it has been determined by that plus or minus 7.0 degrees is sufficient to accommodate hull variation in virtually every known kayak design. Before tightening the four screws 34 to secure motor 30, the operator may rotate and adjust the position of the motor 30 such that the centerline of the motor 30 is approximately equal to the longitudinal axis 9 of the vessel 3. In addition, should the operator desire to change bow lift dynamics of the vessel 3 upon application of the throttle, the pitch of the motor 30 may be easily adjusted.

Figure 27:
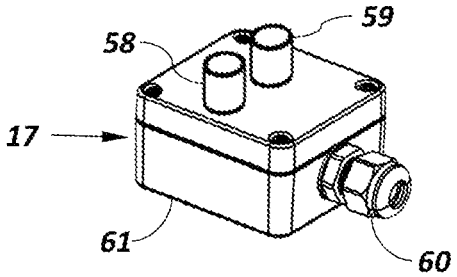
FIG. 27 is a perspective overview of the hand operated motor control device.

FIG. 27 is a perspective view of the hand controller assembly 17 for controlling the speed of the electric motors 30 and 72. This controller 17 is typically mounted onto the vessel 3 as shown in FIG. 11 in a convenient location to the operator's natural hand position. In the preferred embodiment the device includes both a port motor control knob 58 and a starboard motor control knob 59. The dual motor configuration uses rotation of control knobs 58 and 59 to independently alter the speed and direction of rotation of the electric motors 30 and 72, making possible both forward and reverse movement, and also allow for directional steering. This dual motor configuration requires no other input for steering such as a rudder, because both the port and starboard motors provide thrust that can act to turn the vessel.

For example, activating the starboard motor alone will cause the vessel 3 to turn to port. Control knobs 58 and 59 are mounted on the outside of a waterproof housing 61, which holds the potentiometers, which provides the throttle signal to remotely mounted electronic speed controllers (ESC's) that control the motors. Wires routing to and from the batteries and motors to the controller penetrate the housing 61 via waterproof cable gland 60.

Figure 28:
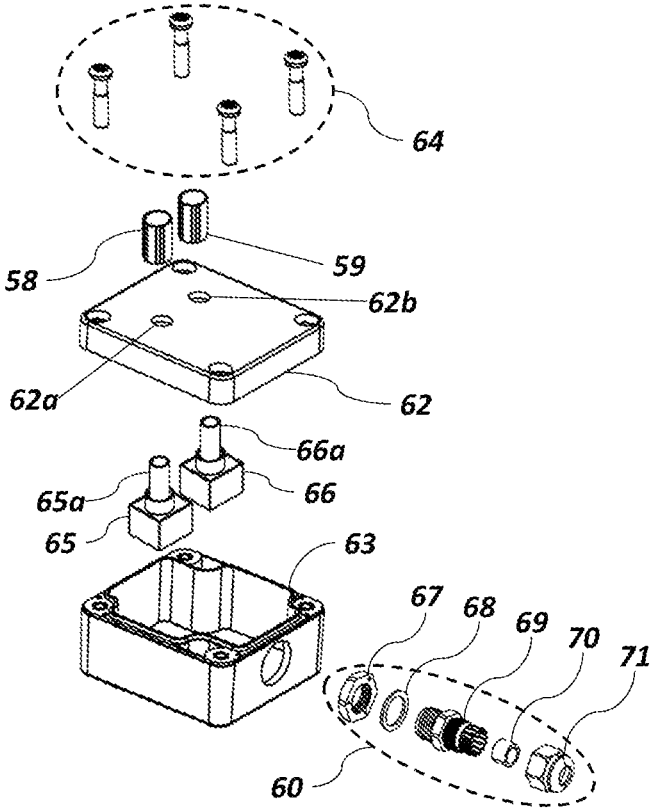
FIG. 28 is an exploded view of the hand operated motor control device.

FIG. 28 is an exploded view of the hand controller 17 showing its components. A gasketed housing 63 serves as the basis to mount a lid 62. A potentiometer 65, having a rotatable spline 65*a*, is partially inserted into a hole 62*a* on lid 62 such that only the spline 65*a* protrudes through lid 62. Port motor control knob 58 attaches to the spline 65*a*. On the starboard half of the controller assembly, a potentiometer 66, having a rotatable spline 66*a*, is partially inserted into a hole 62*b* on lid 62 such that only the spline 65*a* protrudes through lid 62. Starboard motor control knob 59 attaches to the spline 66*a*. The lid 62 attaches to housing 63 using four (4) machined screws 64 with a gasket to create a waterproof seal. Finally, a cable gland assembly 60 mounts to housing 63 to retain the control cables routing to potentiometers 65 and 66. Here, cable gland assembly 60 includes a gasket 68, which is attached to component 69 before being inserted together into housing 63. Once inserted into housing 63, a backing nut 67 is threaded onto the distal end of component 69, creating a water-resistant interface between the cable gland assembly 60 and the housing 63. Once component 69 is retained to housing 63 with backing nut 67, a rubberized gasket 70 is inserted into the inside diameter of component 69. Upon installation of the wiring through cable gland assembly 60, a compression nut 71 tightens the inside of gasket 70 around the outside of the wiring harness to create a water-resistant seal. Together with the gasket between housing 63 and cover 62, the cable gland 60 works to make the entire controller assembly 17 water-resistant.

Figure 29:
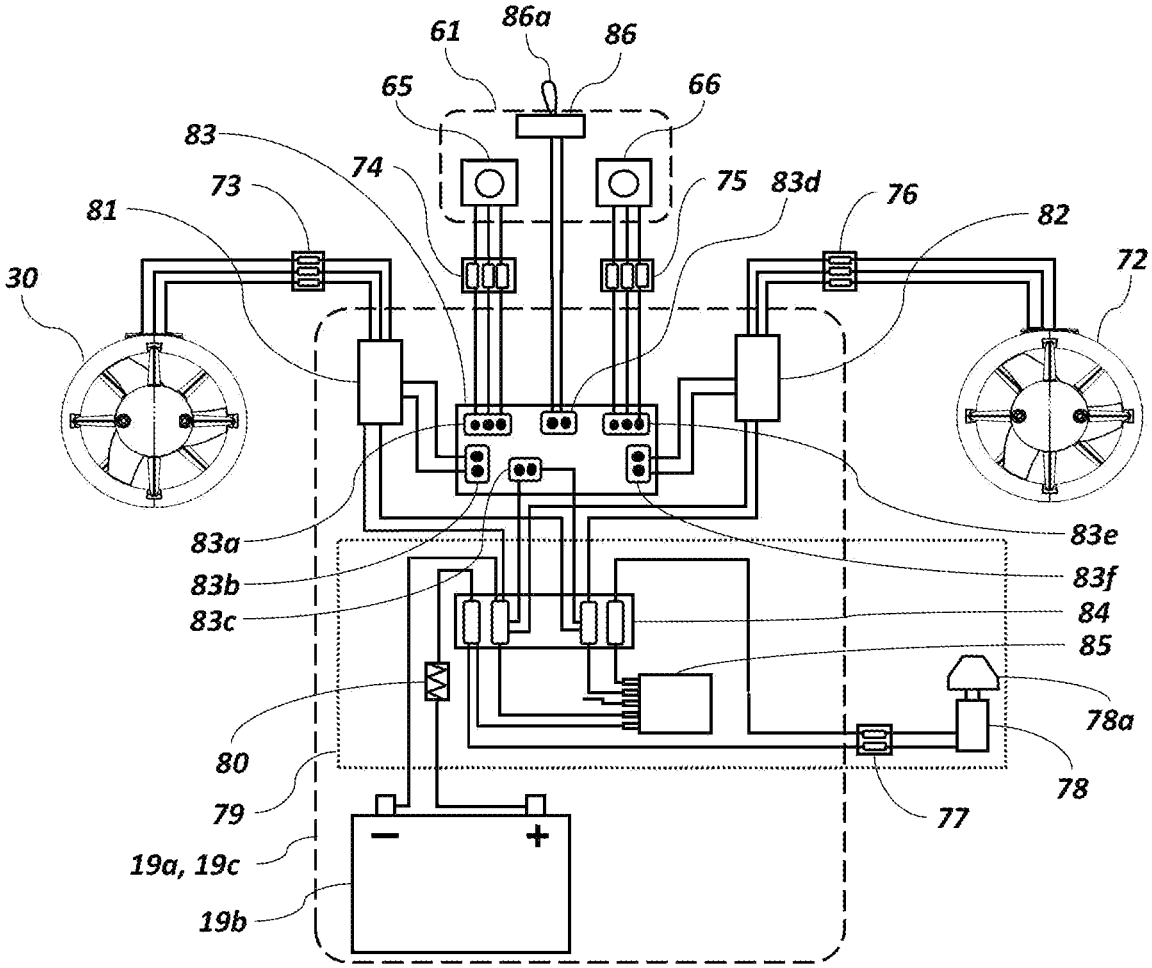
FIG. 29 is a schematic of the overall configuration of the electronics package for the dual motor application embodiment.

FIG. 29 is a schematic including all major electrical components, power source, and motors used in the preferred embodiment. FIG. 29 provides an overview of the electrical design of the preferred embodiment, thought other embodiments may be configured to achieve the result of driving the motor(s). In FIG. 29, a standard 10V-22V battery 19*b* sits inside a splash-proof enclosure 19 formed by combining a battery box 19*a*, with lid 19*c*. Battery 19*b* provides the electromotive energy to a conditional voltage distribution circuit 79, which includes a four-pole terminal block 84, safety device 78, and a 5-pin waterproof relay 85, where fuse 80 exists between the positive pole of battery 19*b* and terminal block 84. To simplify FIG. 29, the functional detail of power distribution circuit 79 is given below, serving to separate the function of the system from the method by which voltage is distributed to all devices in that system. Note here that safety device 78 exists outside enclosure 19 for the purpose of practically attaching a removable plug 78*a*, which connects via tether to an operator. In the given embodiment, safety device 78 is rigidly mounted to left side arm assembly 1, being connected electrically to two separate poles of terminal block 84 via a waterproof 2-pin plug 77. Devices 81, 82, and 83 receive a voltage from 4-pole terminal block 84 based on the combined condition of the power distribution circuit 79.

Assuming a continuous voltage supply to electronic speed controllers (ESC) 81 and 82, and electronic control module (ECM) 83, from power distribution circuit 79, it is possible to describe how the speed and direction of motors 30 and 72 are manipulated by the hand controller 17. There are two rotatable, center detent potentiometers 65 and 66, housed inside enclosure 61 which provide variable resistance according to their rotational position, where the rotational position of potentiometer 65 ultimately determines the speed and rotational direction of motor 30 & 72, using ECM 83 to convert the variable resistance as determined by each respective potentiometer to a resultant timed voltage signal sent to ESC's 81 and 82 from ECM 83. Here, the potentiometers 65 and 66 are connected respectively to three-wire input ports 83*a* and 83*b* on ECM 83 via plugs 74 and 75. ECM 83 is powered by a two-wire connection to port 83*c* from power distribution circuit 79, with an auxiliary on/off switch 86 housed inside the waterproof enclosure 61, where switch 86 is connected at a two-wire port 83*d* to ECM 83, and where discontinuity across switch 86 results in loss of signaling capability from ports 83*b* and 83*f* on ECM 83 to ESC's 81 and 82, respectively, rendering them incapable of turning motors 30 and 72. Note here that toggle switch 86*a* features two positions, one of which creates continuity across switch 86, allowing the ECM 83 to remain powered, with the second position creating discontinuity in switch 86, thereby preventing any potential signaling from ECM 83 to ESC's 81 and/or 82. Due to the mechanism by which switch 86 prevents motor operation in the "off" position, it is understood that auxiliary switch 86 may be employed to temporarily and handily disable motor function in non-emergency scenarios, or any operational condition requiring a quick start or stop cycle. ESC's 81 and 82 are housed inside the battery box enclosure 19*a* with lid 19*c* and are connected to motors 30 and 72 via quick-detach waterproof plugs 73 and 76, respectively. Plugs 73 and 76 are quick connect style with a knurled attachment collar for fast breakdown and removal of the entire system, and are also waterproof.

Each throttle for both port and starboard sides use the same series of mechanisms, wiring, circuitry, and operating voltage conditions, so only the port side components will be described. In the preferred embodiment, potentiometer 65, ECM 83, ESC 81, and motor 30 are all known off-the-shelf components, and are designed to send and receive electronic signals between one another. Potentiometer 65 includes a spline 65*a* attached to a knob 58 capable of a rotational range of 270 degrees. This rotatable knob features a center detent, that is the off position, and is 135 degrees from each end of its mechanical range. This "center" or "0" or "off" position of potentiometer 65 is the reference point at which a resultant output signal to ESC 81 yields no motor movement. The condition of zero motor speed at the center detent position of potentiometer 65 is coded into the firmware of ECM 83, when ECM 83, potentiometer 65, ESC 81, and motor 30 are used in conjunction. Rotating the knob off-center toward either clockwise or counterclockwise serves to change the resistance of potentiometer 65 such that ECM 83 sends a timing signal to ESC 81, causing the motor to spin, with motor speed is increased proportional to the degree to which the knob is turned away from its center detent position. The further you turn the knob, the faster the motor goes. Also, hard coded into ECM 83 and ESC 81 is that the center detent position of potentiometer 65 represents reversal of motor direction. Turning the knob clockwise from center will spin the motor opposite the direction of turning the knob in the counterclockwise direction. Rotating the port side knob clockwise results in forward drive of motor 30, while rotating the knob counterclockwise results in motor 30 being driven in reverse. Likewise, rotation of the starboard side potentiometer 66 counterclockwise results in forward drive of the starboard side motor 72, where clockwise rotation of potentiometer 66 results in motor 72 to be driven in reverse.

Figure 31:
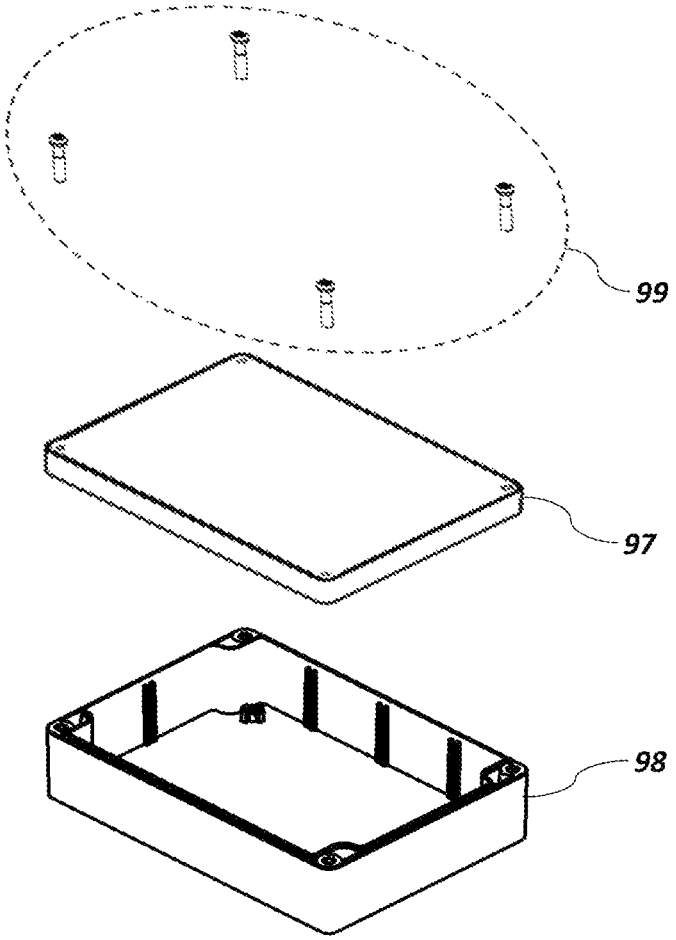
FIG. 31 is an exploded view of the battery box.

All the components shown in FIG. 29 are held within the battery box 19*a* with lid 19*c*, and all the electrical components, except for the battery 19*b*, are mounted together into one enclosure to fix the electronics components in a secure location, and to prevent inadvertent access to major wiring and circuitry. The enclosure is sized to install into all common sizes of marine battery boxes so that it may be swapped between various battery configurations at will. All electrical components whose wiring penetrates the enclosure feature quick plug-in connections at each interface, making the entire electrical assembly modular and capable of being installed into the battery box 19*a* and connected to each other with no special tools required. The enclosure may take on more than one embodiment, with one example shown in FIG. 31, where a lid 97 attaches to the enclosure 98 with screws 99, where the interface between lid 97 and enclosure 98 has a waterproof seal.

Essential to the safety of any device powering kayaks, canoes, or other small vessels is an appropriate way to stop the motor in the event the vessel capsizes and the operator becomes separated from the vessel. The invention disclosed here is intended for hands-free, continuous throttle application, which means that the device is capable of continuous running without continuous input from the operator. This opens the potential for a capsize to lead to an uncontrolled moving vessel. To address this possibility the vessel has a safety switch with a tether attached to the operator which cuts power when the operator is displaced from the vessel. Since most applications for tether kill switches serve the purpose of cutting motor power from an internal combustion engine, their safety circuits provide a simple means of grounding out the source of compression ignition (spark plug voltage source) and are considered a 'closed', or continuous circuit when the safety plug/tether combo is removed from the housing. However, considering the device described herein is designed to be electrically powered, the safety device in question for the application abides by the opposite condition of continuity, and remains closed when the safety plug/tether combo is present rather than absent.

Figure 30:
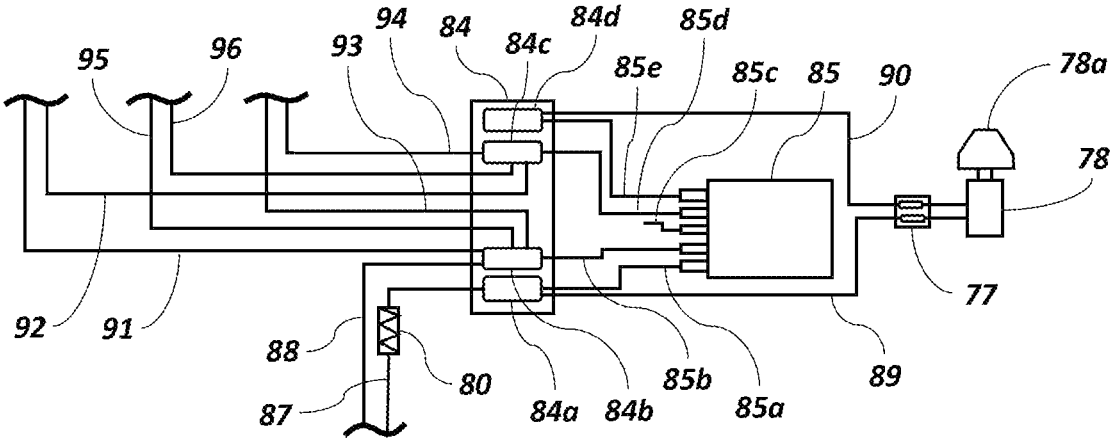
FIG. 30 is a schematic of the connections and components which serve as the safety circuit for the device.

FIG. 30 shows the detail of the safety circuit 79 for the invention, which is a sub-component of the main electric system set out above. Wires 87 and 88 are, respectively, the positive and negative leads from the battery 19*b*. Lead 87 is interrupted with a fuse 80 as a primary means of preventing current overruns or spikes in voltage that could cause damage within the components. Fuse 80 is a marine style waterproof holder with a cap to mitigate water intrusion. The specs of the fuse, wire size(s), and component sizing and specifications depend on motor specifications, which are well known and vary considerably and so are not set forth. All of these components are common and well known in the art and therefore do not need detailed elaboration herein. Wires 87 and 88 terminate on a 4-pole terminal block 84 at nodes 84*a* and 84*b*, respectively. Also, from nodes 84*a* and 84*b*, the positive lead 85*a* and negative lead 85*b* for a waterproof 5-pin relay 85 are connected, respectively. The relay 85 is designed to switch its voltage output to either lead 85*c* or 85*d* depending on the voltage condition at node 84*d*. Note here that lead 85*c* from relay 85 is disconnected from all other circuits, as the function of power distribution circuit is to either add or remove all voltage from the devices included herein rather than redistribute voltage to an alternative circuit, relegating lead 85*c* useless in this application. The decommissioning of lead 85*c* in this application is done because in the 5-pin relay lead 85*c* is continuous with lead 85*a* (normally equal to battery voltage when fuse 80 is intact) until a secondary voltage input (between 10V and 24V) is given to lead 85*e* via node 84*d* on the terminal block. The default continuity of lead 85*a* with lead 85*c* is true when no voltage has been applied to any component and no switching has occurred in the circuit. Alternative to lead 85*c*, lead 85*d* is energized simultaneous to the de-energization of lead 85*c* when a voltage between 10 and 24V is applied to lead 84*d*. This switching of voltage output from lead 85*c* to lead 85*d* is the primary function of the relay 84, made possible only through a voltage application to node 84*d* from lead 90. The energization of lead 90 is only possible when lead 89, supplying the battery voltage from node 85*a* is made continuous with lead 90. Continuity of lead 89 to 90 is only possible when two conditions are met: 1) the waterproof plug 77 is made and 2) when the switch inside safety device 78 is continuous. Continuity of device 78 is predicated on the presence of a safety plug 78*a*, which is attached to a tether and ultimately to an operator. Presence of the safety plug 78*a* creates continuity between leads 89 and 90, and thus discontinuity occurs when the plug 78*a* is removed in the event an operator becomes disconnected from the vessel. Thus, the conditions leading to the energization of lead 85*d*, which ultimately supplies voltage to all onboard powered devices, occurs only when a battery is connected to leads 87 and 88, the fuse 80 is intact, connection 77 is made with the safety switch 78, and plug 78*a* is present in the safety device 78. With a common ground node 85*b* connecting both the negative battery lead 88 to the lead 85*b* from the 5-pin relay, a voltage differential equal to the battery voltage is applied between leads 91 and 92, leads 93 and 94, and leads 95 and 96, providing voltage to the port side ESC 81, the starboard side ESC 82, and the electronic control module 83, respectively. Together, the conditions necessary to energize ESC's 81 and 82 result in a device safe for the consumer and free from the possibility of an unmanned vessel creating a hazard for either the operator or other boaters and swimmers. Note here that the resultant conditions necessary to power any component within the system depends, ultimately, on an intact fuse 80 as well as presence of safety plug 78*a*.

In use, the operator of the kayak, of other similar small water vessel such as a canoe, will drill four properly spaced mounting holes, two on the port side gunnel 13 & 14, and two on the starboard side gunnel 15 & 16, and will insert the well nut 49 of four clamps 37 into the four holes and will tighten the well nuts 49 to secure the clamps 37 to the vessel 3. Two axle assemblies 39 are then attached to the clamps 37, one on each side. Typically, the weldment 43 will already be in place on the axle 40, the adjustable arm 22 will already be attached to weldment 43, and the motor 30 or 72 will be attached to the adjustable arm 22. The operator will determine the depth of the motors 30 and 72 to provide proper clearance below the hull of the vessel 3, and will adjust the attachment of the adjustable able arm 29 to the L-shaped top member 28 at the appropriate attaching points to achieve the desired depth or level of the motors 30 and 72. The operator can then adjust, as needed, the pitch of the motors 30 and 72 by means of the slotted holes 29*b*, 29*c*, 29*d*, and 29*e*. If necessary, the operator can also adjust the yaw of the motors 30 and 72 by means of the adjustment slots that attach the L-shaped upper attachment member 28 to the attachment plate 43*c* of the weldment 43. The motor mounts 1 and 2 can be placed in the retracted position to move the vessel 3 into the water, and then at the appropriate time, the motors can be moved into the water by unclamping the stud/handle 41 to allow the motor mounts 1 and 2 to rotate on the axle 40, to lower the motors into the water in the extended position. The user can then power the vessel 3 by manipulating the hand controller 17. To move forward, both the starboard 58 and port 59 control knobs are turned and both motors will engage and propel the vessel 3 forward. The vessel can be turned by altering the speed of one, or both, motors. In the simplest example, the vessel 3 can be turned to port by increasing the speed of the starboard motor.

As has been demonstrated from the sections above, the device for retro-fitting electric motors onto a kayak or canoe which utilizes torque-vector steering has been shown as both versatile and practical. The present invention is well adapted to carry out the objectives and attain both the ends and the advantages mentioned, as well as other benefits inherent therein. While the present invention has been depicted, described, and is defined by reference to particular embodiments of the invention, such reference does not imply a limitation to the invention, and no such limitation is to be inferred. The depicted and described embodiments of the invention are exemplary only, and are not exhaustive of the scope of the invention. Consequently, the present invention is intended to be limited only be the spirit and scope of the claims, giving full cognizance to equivalents in all respects.

We claim:

1. A motor mount for a small non-powered vessel, comprising:

a pair of mounting holes drilled into a gunnel of the vessel;

a pair of adjustable clamps having well-nuts, wherein said well-nuts are removably inserted and secured into said mounting holes;

an axle having a distal and a proximal end secured in said adjustable clamps;

a rotatable weldment rotatably attached to said axle, said weldment having an attachment plate;

an L-shaped mounting arm having a horizontal plate and a vertical plate, wherein said horizontal plate is rotatably attached to said attachment plate;

an adjustable lower member attached to said vertical plate;

a motor rotatably attached to said adjustable lower member;

wherein said weldment can be rotated about said axle to position said motor into or out of the water.

2. The motor mount for a small non-powered vessel of claim 1, wherein said vessel has a starboard side and a starboard gunnel and a port side and a port gunnel, and wherein further there are two mounting holes on said port gunnel and two mounting holes on said starboard gunnel, and wherein further there are two motor mounts, one having a port motor attached on the port side, and one having a starboard motor attached on the starboard side.

3. The motor mount for a small non-powered vessel of claim 2, wherein said vessel has a center point of mass, with;

a longitudinal axis running from a bow of the vessel to a stern of the vessel through said center point of mass, wherein the vessel may roll about the longitudinal axis;

a vertical axis running vertically through said center point of mass, wherein the vessel may yaw about the vertical axis and the bow of the vessel may move left or right;

a lateral axis running from the port side of the vessel to the starboard side of the vessel through the center point of mass, wherein the vessel may pitch about the lateral axis and the bow of the vessel may move up or down.

4. The motor mount for a small non-powered vessel of claim 3, wherein said axle is mounted parallel to said longitudinal axis of said vessel, and wherein the port motor and the starboard motors have a direction of thrust parallel to said longitudinal axis of said vessel.

5. The motor mount for a small non-powered vessel of claim 4, wherein said adjustable clamp allows the user to adjust a rotational position of the axle to adjust a roll position of the motor.

6. The motor mount for a small non-powered vessel of claim 4, wherein said rotational attachment between the weldment attachment plate and the horizontal plate allows a user to adjust the position of said L-shaped mounting arm in the yaw orientation and thereby adjust the yaw orientation of said motor.

7. The motor mount for a small non-powered vessel of claim 4, wherein said rotational attachment between the vertical plate and the motor allow the user to adjust the pitch orientation of said motor.

8. The motor mount for a small non-powered vessel of claim 4, wherein said adjustable lower member includes a series of spaced attachment holes and wherein said vertical plate has a single set of alignment holes, whereby the adjustable lower member can be attached at different holes to adjust the depth of the motor.

9. The motor mount for a small non-powered vessel of claim 4, wherein said rotational attachment between said adjustable lower member and the motor consists of a multiplicity of circumferential slots on adjustable lower member and a multiplicity of screws to attach the motor to said adjustable lower member, wherein the slots are sized to allow the motor to rotate and the pitch of said motor to be adjusted up to seven degrees above or below parallel to said longitudinal axis, whereby the pitch of the trust of the motor can be adjusted.

10. The motor mount for a small non-powered vessel of claim 4 wherein said axle includes an alignment screw threadedly attached to said axle, and said weldment includes an alignment slot disposed around said alignment screw to keep weldment aligned on said axle.

11. The motor mount for a small non-powered vessel of claim 4, wherein said axle includes a threaded locking hole, said weldment includes a locking slot aligned with said threaded locking hole and including a flat top rest on top of said weldment and a flat bottom rest on the bottom of said weldment, and a threaded axle clamp configured to threadedly screws into said threaded locking hole, wherein said axle clamp can screw down onto said flat top rest to secure said weldment in position with said motor in the water, and wherein said axle clamp can screw down onto said flat bottom rest to secure said weldment in position with said motor out of the water.

12. The motor mount for a small non-powered vessel of claim 11, wherein when said adjustment arm and motor are locked into the down and in the water position the clamp and axle are close to the gunnel and do not create any obstruction to the vessel, and wherein when said adjustable arm and motor are locked in the up and out of the water position, the profile of the vessel in the water is the same as when there is no motor.

13. The motor mount for a small non-powered vessel of claim 4, wherein the motor is powered by a battery and controlled by a hand-held controller having a port control knob that controls the port motor and a starboard control knob that controls the starboard motor, and wherein an operator of the vessel can control the speed of the vessel, and can turn the vessel by altering the power on each side motors.

14. The motor mount for a small non-powered vessel of claim 13, wherein the port control knob and the starboard control knob each has a center detent wherein no power is supplied to the motor, and wherein when the knob is turned clockwise forward power is supplied to the motor and the speed of the motor increases when the knob is turned further clockwise, and wherein when the knob is turned counterclockwise reverse power is supplied to the motor and the speed of the motor increases when the knob is turned further counterclockwise, thereby allowing the operator to control the speed and direction of the vessel through alternating the power of the two separate motors.

15. A device for mounting an electric motor to a small non-powered vessel having a hull with a port side with a port side gunnel and a starboard side with a starboard side gunnel, said device comprising:

a pair of mounting holes drilled into one of said gunnels of the vessel;

a pair of adjustable clamps having well-nuts, wherein said well-nuts are removably inserted and secured into said mounting holes;

an axle having a distal and a proximal end secured in said adjustable clamps;

a rotatable weldment rotatably attached to said axle, said weldment having a weldment attachment plate;

an L-shaped mounting arm having a horizontal plate and a vertical plate, wherein said horizontal plate is rotatably attached to said attachment plate;

an adjustable lower member attached to said vertical plate;

a motor rotatably attached to said adjustable lower member, wherein said motor has a direction of thrust;

wherein said weldment can be rotated about said axle to position said motor into or out of the water;

wherein further said vessel has a center point of mass, and a longitudinal axis running longitudinally from a bow of the vessel to a stern of the vessel through said center point of mass, wherein the vessel may roll about said longitudinal axis; a vertical axis running vertically through said center point of mass, wherein the vessel may yaw about the vertical axis and the bow of the vessel may move left or right; a lateral axis running laterally from the port side of the vessel to the starboard side of the vessel through the center point of mass, wherein the vessel may pitch about the lateral axis and the bow of the vessel may move up or down;

wherein said axle is mounted parallel to said longitudinal axis of said vessel;

wherein said rotational attachment between the weldment attachment plate and the horizontal plate allows an operator to adjust the position of said L-shaped mounting arm in the yaw orientation and thereby adjust a yaw orientation of said motor;

wherein said rotational attachment between said adjustable lower member and the motor consists of a multiplicity of circumferential slots on adjustable lower member and a multiplicity of screws to attach the motor to said adjustable lower member, wherein the slots are sized to allow the motor to rotate and the pitch of said motor to be adjusted up to seven degrees above or below parallel to said longitudinal axis, whereby the pitch the motor can be adjusted;

wherein said adjustable clamp allows the user to adjust a rotational position of the axle to adjust a roll position of the motor;

wherein said adjustable lower member includes a series of spaced attachment holes and wherein said vertical plate has a single set of alignment holes, whereby the adjustable lower member can be attached at different holes to alter a depth of the motor;

wherein said axle includes an alignment screw threadedly attached to said axle, and said weldment includes an alignment slot disposed around said alignment screw to keep weldment aligned on said axle;

wherein said axle includes a threaded locking hole, said weldment includes a locking slot aligned with said threaded locking hole and including a flat top rest on a top of said weldment and a flat bottom rest on a bottom of said weldment, and a threaded axle clamp configured to threadedly screws into said threaded locking hole, wherein said axle clamp can screw down onto said flat top rest to secure said weldment in position with said motor in the water, and wherein said axle clamp can screw down onto said flat bottom rest to secure said weldment in position with said motor out of the water;

whereby when said adjustment arm and motor are locked into the down and in the water position the clamp and axle are close to the gunnel and thereby do not create any obstruction to the vessel, and wherein when said adjustable arm and motor are locked in the up and out of the water position, the profile of the vessel in the water is the same as when there is no motor.

16. A device for mounting an electric motor to a small non-powered vessel of claim 15, wherein the motor is powered by a battery and controlled by a hand-held controller having a knob with a center detent wherein no power is supplied to the motor at said center detent, and wherein when the knob is turned clockwise forward power is supplied to the motor and the speed of the motor increases when the knob is turned further clockwise, and wherein when the knob is turned counterclockwise reverse power is supplied to the motor and the speed of the motor increases when the knob is turned further counterclockwise, thereby allowing the operator to control the forward and rearward movement as well as the directional control of the vessel.

17. A device for mounting an electric motor to a small non-powered vessel of claim 16, wherein there is a device for mounting an electric motor attached to the side port gunnel and a device for mounting an electric motor attached to the starboard side gunnel, and wherein further said hand-held controller has two knobs, a port control knob to control the port motor, and a starboard control knob to control the starboard motor;

whereby the operator can control the forward and rearward movement of the vessel as well as steer the vessel by independently altering the power and direction of the port and starboard motors.

* * * * *